US008503906B2

(12) United States Patent
Suzuki et al.

(10) Patent No.: US 8,503,906 B2
(45) Date of Patent: Aug. 6, 2013

(54) PROCESS CARTRIDGE AND ASSEMBLING, DISASSEMBLING REMANUFACTURING METHOD THEREFOR

(75) Inventors: Tatsuya Suzuki, Suntou-gun (JP); Kazuo Chadani, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 1293 days.

(21) Appl. No.: 12/196,726

(22) Filed: Aug. 22, 2008

(65) Prior Publication Data

US 2009/0297208 A1 Dec. 3, 2009

(30) Foreign Application Priority Data

May 27, 2008 (JP) ..... 2008-137769

(51) Int. Cl.
*G03G 15/00* (2006.01)
*G03G 21/16* (2006.01)

(52) U.S. Cl.
USPC ..... 399/109; 399/110; 399/111

(58) Field of Classification Search
USPC ..... 399/109–111
See application file for complete search history.

(56) References Cited

U.S. PATENT DOCUMENTS

| | | | | |
|---|---|---|---|---|
| 5,943,529 | A | 8/1999 | Miyabe et al. | 399/111 |
| 5,966,567 | A | 10/1999 | Matsuzaki et al. | 399/111 |
| 6,144,815 | A | 11/2000 | Chadani et al. | 399/27 |
| 6,173,140 | B1 | 1/2001 | Suzuki et al. | 399/113 |
| 6,173,145 | B1 | 1/2001 | Chadani et al. | 399/265 |
| 6,178,302 | B1 | 1/2001 | Nagashima et al. | 399/106 |
| 6,205,305 | B1 | 3/2001 | Suzuki et al. | 399/106 |
| 6,219,504 | B1 | 4/2001 | Matsuzaki et al. | 399/92 |
| 6,282,389 | B1 | 8/2001 | Matsuzaki et al. | 399/111 |
| 6,301,457 | B1 | 10/2001 | Chadani et al. | 399/167 |
| 6,473,585 | B2 | 10/2002 | Abe et al. | 399/254 |
| 6,505,007 | B2 | 1/2003 | Miura et al. | 399/27 |
| 6,512,903 | B2 | 1/2003 | Chadani | 399/106 |
| 6,535,699 | B1 | 3/2003 | Abe et al. | 399/27 |
| 6,643,482 | B2 | 11/2003 | Higeta et al. | |
| 6,671,474 | B2 | 12/2003 | Chadani | 399/106 |
| 6,681,088 | B2 | 1/2004 | Kanno et al. | 399/111 |
| 6,703,094 | B2 | 3/2004 | Kakii et al. | 428/36.91 |
| 6,795,666 | B2 | 9/2004 | Miyabe et al. | 399/109 |
| 6,823,155 | B2 | 11/2004 | Tsuda et al. | 399/111 |
| 6,931,226 | B2 | 8/2005 | Chadani et al. | 399/109 |
| 6,934,485 | B2 | 8/2005 | Miyabe et al. | 399/90 |

(Continued)

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An assembling method for a process cartridge the assembling method includes a step of preparing a drum unit supporting a electrophotographic photosensitive drum; a step of preparing a developing unit supporting a developing roller for developing a electrostatic latent image formed on the electrophotographic photosensitive drum a developer supplying roller for supplying a developer to the developing roller and a developer accommodating portion having a developer supply opening; a unit coupling process of coupling the drum unit and the developing unit with each other; a first-end developing-device spacing member mounting step after the unit coupling process of engaging with a opening provided at a first end portion of the drum unit a first-end developing-device spacing member provided rotatably about a shaft at a first end portion of the developing unit to regulate rotation of the developing unit relative to the drum unit; and a second-end developing-device spacing member mounting step of engaging, with a projection provided at a second end portion of the drum unit, a second-end developing-device spacing member provided rotatably about a shaft at a second end portion of the developing unit to regulate rotation of the developing unit relative to the drum unit.

6 Claims, 30 Drawing Sheets

U.S. PATENT DOCUMENTS

| | | | | |
|---|---|---|---|---|
| 6,980,759 | B2 | 12/2005 | Kanno et al. | 399/111 |
| 7,027,756 | B2 | 4/2006 | Hoshi et al. | 399/111 |
| 7,072,594 | B2 | 7/2006 | Hoshi et al. | 399/27 |
| 7,072,603 | B2 | 7/2006 | Tsuzuki et al. | 399/111 |
| 7,136,604 | B2 | 11/2006 | Chadani et al. | 399/90 |
| 7,162,181 | B2 | 1/2007 | Maeshima et al. | 399/109 |
| 7,184,682 | B2 | 2/2007 | Chadani et al. | 399/90 |
| 7,433,622 | B2 | 10/2008 | Chadani et al. | 399/90 |
| 2001/0041080 | A1* | 11/2001 | Higeta et al. | 399/109 X |
| 2006/0228132 | A1 | 10/2006 | Chadani et al. | 399/111 |
| 2008/0138114 | A1 | 6/2008 | Chadani et al. | 399/167 |
| 2008/0138115 | A1 | 6/2008 | Chadani et al. | 399/167 |
| 2008/0240773 | A1 | 10/2008 | Sato et al. | 399/106 |

* cited by examiner

PROCESS CARTRIDGE AND ASSEMBLING, DISASSEMBLING REMANUFACTURING METHOD THEREFOR

FIELD OF THE INVENTION AND RELATED ART

The present invention relates to an assembling method, a disassembling method and a remanufacturing method for a process cartridge dismountably mountable to a main assembly of an electrophotographic image forming apparatus, and the process cartridge.

Here, in the present invention, the process cartridge is a cartridge which contains integrally a photosensitive drum and at least developing means as process means actable on the drum, it is dismountably mounted to an electrophotographic image forming apparatus main assembly as a unit.

The electrophotographic image forming apparatus forms an image on the recording material using an electrophotographic type process. As an example of the electrophotographic image forming apparatus, there are an electrophotographic copying machine, an electrophotographic printer, a LED printer, a laser beam printer, a facsimile device, a word processor, and so on.

In addition, the apparatus main assembly of the electrophotographic image forming apparatus is a portion of the electrophotographic image forming apparatus except the process cartridge.

According to this process cartridge type, maintenance of an image forming apparatus can be carried out by a user independently from a service person, and therefore, the operativity can be remarkably improved.

In addition, in the electrophotographic image forming apparatus, the image is formed on the recording material using a developer. Therefore, the developer contained in a developer accommodating portion is consumed in accordance with the repetition of the image formation in the process cartridge which has the developing means. When the developer has been consumed to the extent that it is impossible to form the image of the quality which can satisfy the user of the process cartridge, the process cartridge is unusable.

Heretofore, the simple remanufacturing method for the process cartridge which can commercialize again the process cartridge having become unusable as a result of consumption of the developer is desired, and a method therefor has been proposed (U.S. Pat. No. 6,643,482).

In addition, an easy assembling method for the process cartridge has been desired.

The present invention provides a further development in the assembling method for process cartridge, the disassembling method for process cartridge, the remanufacturing method for process cartridge, and the process cartridge.

SUMMARY OF THE INVENTION

Accordingly, it is a principal object of the present invention to provide the process cartridge with an easy assembling.

It is another object of the present invention to provide an assembling method for the process cartridge with the simple assembling.

It is a further object of the present invention to provide a disassembling method for the process cartridge with a simple disassembling.

It is a further object of the present invention to provide a simple remanufacturing method for the process cartridge.

It is a further object of the present invention to provide the remanufacturing method for the process cartridge which can commercialize again the process cartridge having become unusable as a result of consumption of the developer.

It is a further object of the present invention to provide a remanufacturing method for the process cartridge which accomplishes a simple refilling operation of the developer.

According to the present invention, a process cartridge which can be assembled easily is provided. According to the present invention, a process cartridge which can be disassembled easily is provided. According to the present invention, a simple remanufacturing method for the process cartridge is provided. According to the present invention, a remanufacturing method for the process cartridge which can commercialize again the process cartridge having become unusable as a result of consumption of the developer is accomplished. According to the present invention, the developer is easily refilled in the process cartridge from which the developer has been consumed.

According to an aspect of the present invention, there is provided an assembling method for a process cartridge, said assembling method comprising a step of preparing a drum unit supporting a electrophotographic photosensitive drum; a step of preparing a developing unit supporting a developing roller for developing a electrostatic latent image formed on said electrophotographic photosensitive drum a developer supplying roller for supplying a developer to said developing roller and a developer accommodating portion having a developer supply opening; a unit coupling process of coupling said drum unit and said developing unit with each other; a first-end developing-device spacing member mounting step after said unit coupling process of engaging with a opening provided at a first end portion of said drum unit a first-end developing-device spacing member provided rotatably about a shaft at a first end portion of said developing unit to regulate rotation of said developing unit relative to said drum unit; and a second-end developing-device spacing member mounting step of engaging, with a projection provided at a second end portion of said drum unit, a second-end developing-device spacing member provided rotatably about a shaft at a second end portion of said developing unit to regulate rotation of said developing unit relative to said drum unit.

According to another aspect of the present invention, there is provided a disassembling method for a process cartridge, wherein the process cartridge includes a drum unit and a developing unit, wherein said drum unit supports an electrophotographic photosensitive drum, and said developing unit supports a developing roller for developing an electrostatic latent image formed on said electrophotographic photosensitive drum, a developer supplying roller for supplying a developer to said developing roller and a developer accommodating portion having a developer supply opening, said method comprising a spring dismounting step of dismounting a tension spring which has a first end mounted to said drum unit and a second end mounted to said developing unit and which urges said developing roller to said electrophotographic photosensitive drum; a shaft dismounting step of dismounting a first end shaft and a second end shaft which swingably couple said drum unit and said developing unit with each other; a first-end developing-device spacing member releasing step of disengaging, from an opening provided at a first end of said drum unit, a first-end developing-device spacing member provided rotatably about a shaft at the first end of said developing unit to permit rotation of said developing unit relative to said drum unit; and a second-end developing-device spacing member releasing step of disengaging, from an opening provided at a second end of said drum unit, a second-end developing-device spacing member provided rotatably about a shaft at the second end of said developing unit to permit rotation of said developing unit relative to said drum unit.

According to a further aspect of the present invention, there is provided a remanufacturing method for a process cartridge, wherein the process cartridge includes a drum unit and a developing unit, wherein said drum unit supports an electrophotographic photosensitive drum, and said developing unit supports a developing roller for developing an electrostatic latent image formed on said electrophotographic photosensitive drum, a developer supplying roller for supplying a developer to said developing roller and a developer accommodating portion having a developer supply opening, said method comprising a spring dismounting step of dismounting a tension spring which has a first end mounted to said drum unit and a second end mounted to said developing unit and which urges said developing roller to said electrophotographic photosensitive drum; a shaft dismounting step of dismounting a first end shaft and a second end shaft which swingably couple said drum unit and said developing unit with each other; a first-end developing-device spacing member releasing step of disengaging, from an opening provided at a first end of said drum unit, a first-end developing-device spacing member provided rotatably about a shaft at the first end of said developing unit to permit rotation of said developing unit relative to said drum unit; and a second-end developing-device spacing member releasing step of disengaging, from an opening provided at a second end of said drum unit, a second-end developing-device spacing member provided rotatably about a shaft at the second end of said developing unit to permit rotation of said developing unit relative to said drum unit; a unit separating step of separating said drum unit and said developing unit from each other; a drum dismounting step of dismounting said electrophotographic photosensitive drum from said drum unit; a developing roller dismounting step of dismounting said developing roller from said developing unit; then a developing blade dismounting step of dismounting, from said developing unit, a developing blade for regulating an amount of a developer deposited on a peripheral surface of said developing roller; then a developer supplying roller dismounting step of dismounting a developer supplying roller from said developing unit; a developer refilling step of refilling a developer into said developer accommodating portion through said developer supply opening exposed; a drum mounting step of mounting a fresh electrophotographic photosensitive drum in said drum unit; a developer supplying roller mounting step of mounting said developer supplying roller to said developing unit; a developing blade mounting step of mounting said developing blade to said developing unit; a developing roller mounting step of mounting said developing roller to said developing unit; a unit coupling process of swingably coupling said drum unit and said developing unit with each other using said first end shaft and said second end shaft; a spring mounting step of mounting the first end of the tension spring to said drum unit and mounting the second of the tension spring to said developing unit; a first-end developing-device spacing member mounting step of engaging said first-end developing-device spacing member with the opening provided at the first end of said drum unit; and a second-end developing-device spacing member mounting step of engaging, with a projection provided at a second end portion of said drum unit, the second-end developing-device spacing member.

According to a further aspect of the present invention, there is provided a remanufacturing method for a process cartridge, wherein the process cartridge includes a drum unit and a developing unit, wherein said drum unit supports an electrophotographic photosensitive drum, and said developing unit supports a developing roller for developing an electrostatic latent image formed on said electrophotographic photosensitive drum, a developer supplying roller for supplying a developer to said developing roller and a developer accommodating portion having a developer supply opening, said method comprising a spring dismounting step of dismounting a tension spring which has a first end mounted to said drum unit and the second end mounted to said developing unit and which urges said developing roller to said electrophotographic photosensitive drum; a unit separating step of separating said drum unit and said developing unit from each other by dismounting a first end shaft and a second end shaft which couple said drum unit and said developing unit from each other; a first-end developing-device spacing member releasing step of disengaging, from an opening provided at a first end of said drum unit, a first-end developing-device spacing member provided rotatably about a shaft at the first end of said developing unit to permit rotation of said developing unit relative to said drum unit; and a second-end developing-device spacing member releasing step of disengaging, from an opening provided at a second end of said drum unit, a second-end developing-device spacing member provided rotatably about a shaft at the second end of said developing unit to permit rotation of said developing unit relative to said drum unit; first end drum bearing dismounting step of dismounting a first end drum bearing from said drum unit by dismounting a screw; a second end drum bearing dismounting step of dismounting a second end drum bearing from said drum unit by dismounting a screw; a drum dismounting step of dismounting said electrophotographic photosensitive drum from said drum unit; a first end bearing member dismounting step of dismounting a first end side cover by dismounting a screw, and subsequently dismounting an Oldham coupling for receiving a rotating force for rotating said developing roller and subsequently dismounting a first end bearing member; a second end bearing member dismounting step of dismounting a second end side cover by dismounting a screw, and subsequently dismounting a plurality of gears, subsequently dismounting a second end bearing member; a developing roller dismounting step of dismounting a developing roller from said developing unit; then a developing blade dismounting step of dismounting a developing blade for regulating an amount of the developer deposited on a peripheral surface of said developing roller from said developing unit; a developer supplying roller dismounting step of dismounting a developer supplying roller from said developing unit; a developer refilling step of refilling a developer into said developer accommodating portion through said developer supply opening exposed; a first end drum bearing mounting step of mounting said first end drum bearing in said drum unit using the screw while supporting a first end drum shaft of a fresh electrophotographic photosensitive drum by said first end drum bearing; a second end drum bearing mounting step of mounting said second end drum bearing in said drum unit using the screw while supporting a second end drum shaft of said fresh electrophotographic photosensitive drum by said second end drum bearing; a first end developing roller mounting step of mounting said first end bearing member to said developing unit using the screw while supporting a first end roller shaft of said developing roller by said first end bearing member, mounting said Oldham coupling, and subsequently mounting said first end side cover using the screw; a second end developing roller mounting step of mounting said second end bearing member to said developing unit using the screw while supporting a second end roller shaft of said developing roller by said second end bearing member, mounting said gears, and subsequently mounting said second end side cover using the screw; a unit coupling process of swingably coupling said drum unit and said developing unit with each other using said first end shaft and said second end shaft; a spring mounting step of mounting the first end of the tension spring to said drum unit and mounting the second end of the tension spring to said developing unit; a first-end developing-device spacing member mounting step of engaging said first-end developing-device spacing member with the opening provided at the first end of said drum unit; and a second-end developing-device spacing member mounting step of engaging, with a projection provided at a second end portion of said drum unit, a second-end developing-device spacing member provided rotatably about a shaft at a second end portion of said developing unit to regulate rotation of said developing unit relative to said drum unit.

According to a further aspect of the present invention, there is provided a process cartridge detachably mountable in a main assembly of an electrophotographic image forming apparatus, comprising an electrophotographic photosensitive drum; a drum unit supporting said electrophotographic photosensitive drum; a developing roller for developing an electrostatic latent image formed on said electrophotographic photosensitive drum while being in contact with said electrophotographic photosensitive drum; a developer supplying roller for supplying the developer to said developing roller; a developer accommodating portion accommodating the developer to be used for developing the electrostatic latent image by said developing roller and having a developer supply opening for supplying the accommodated developer to said developing roller; a developing unit swingably coupled with said drum unit and supporting said developing roller, said developer supplying roller and said developer accommodating portion; a first-end developing-device spacing member provided rotatably about an axis of a shaft at a first end portion of said developing unit to limit rotation of said developing unit relative to said drum unit to maintain spacing between said developing roller and said electrophotographic photosensitive drum; a second-end developing-device spacing member provided rotatably about an axis of a shaft at a second end portion of said developing unit to limit rotation of said developing unit relative to said drum unit to maintain spacing between said developing roller and said electrophotographic photosensitive drum.

These and other objects, features and advantages of the present invention will become more apparent upon consideration of the following description of the preferred embodiments of the present invention, taken in conjunction with the accompanying drawings. In the following description of the embodiments, the like reference numerals are assigned to the elements having the corresponding functions throughout the description.

DESCRIPTION OF THE PREFERRED EMBODIMENTS

Embodiment 1

As to a process cartridge (cartridge) and a color electrophotographic image forming apparatus (image forming apparatus) according to a first embodiment of the present invention, the description will be made in conjunction with the accompanying drawings.

(General Arrangement of Image Forming Apparatus)

Figure 2:
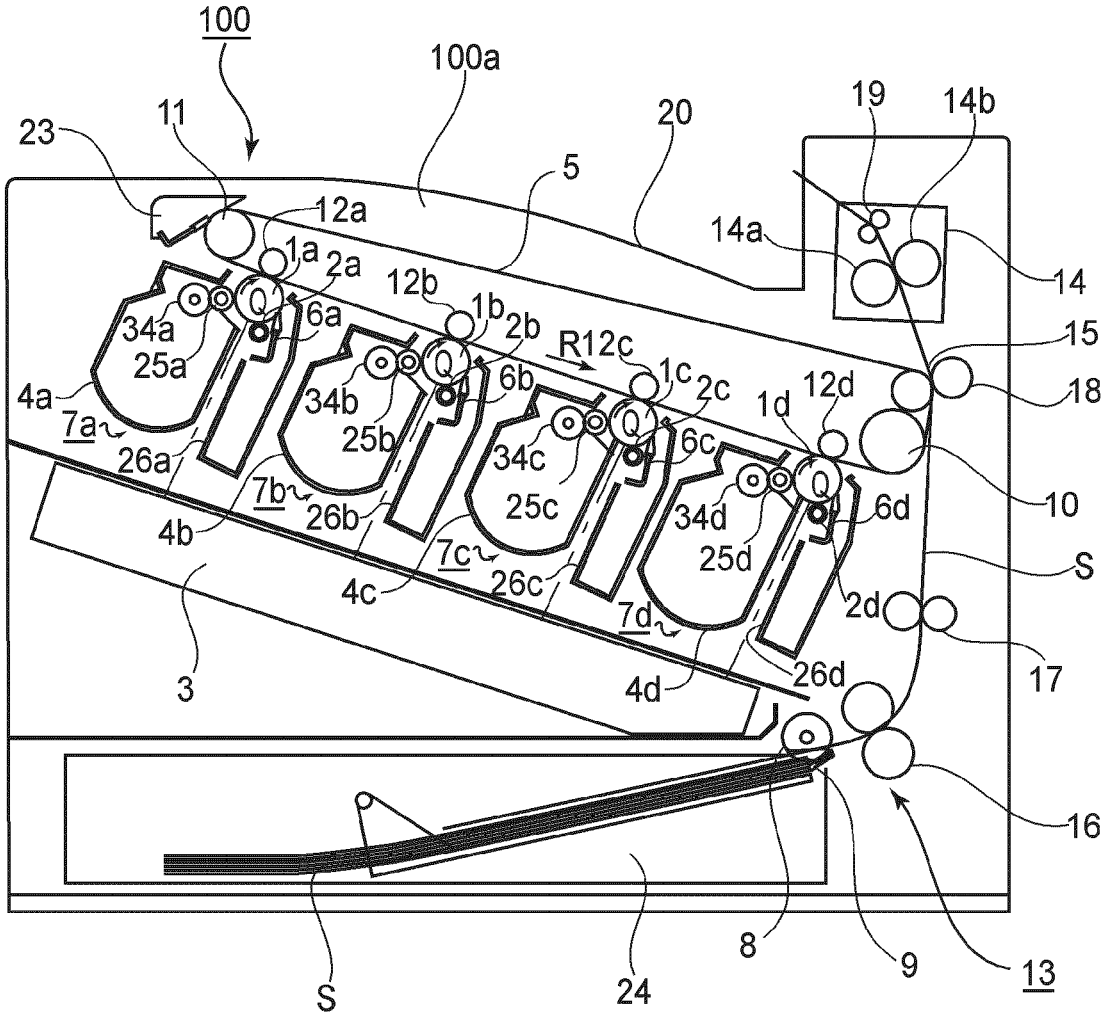
FIG. 2 is a general arrangement of a color electrophotographic image forming apparatus according to the embodiment of the present invention.
Figure 4:
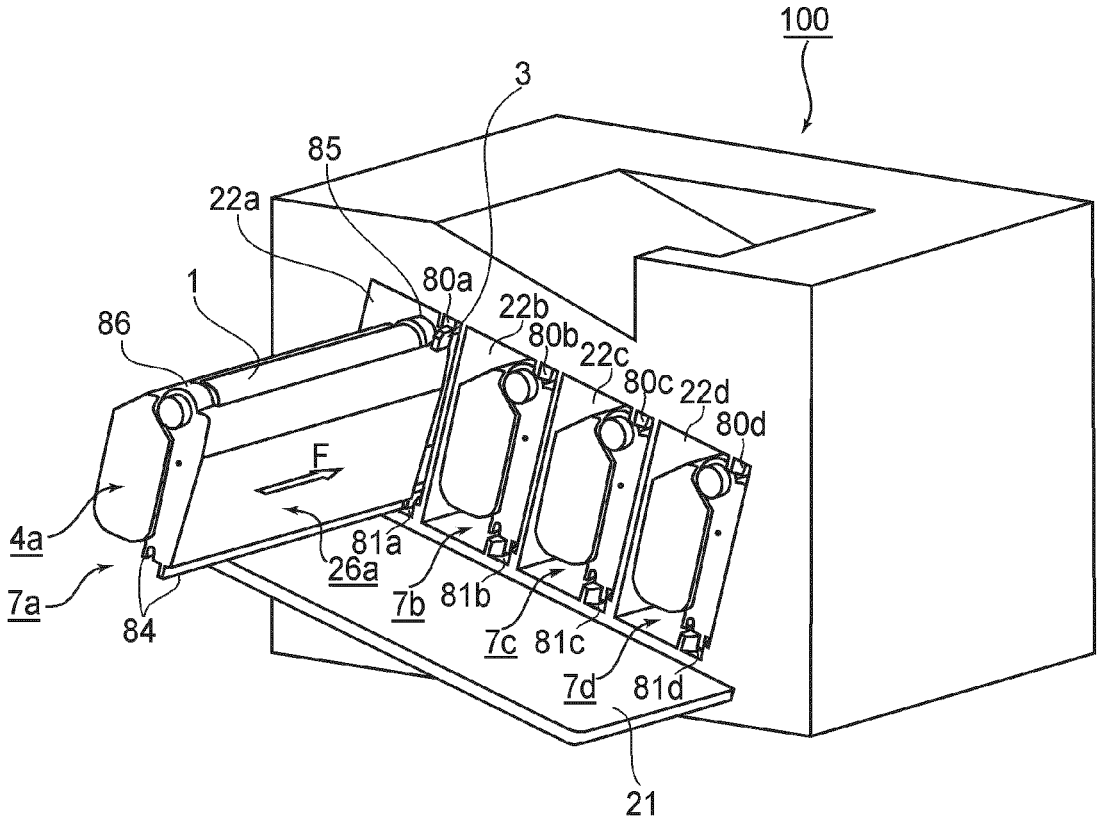
FIG. 4 is a perspective view of the cartridge illustrating a state before mounting to a main assembly of the image forming apparatus.
Figure 5:
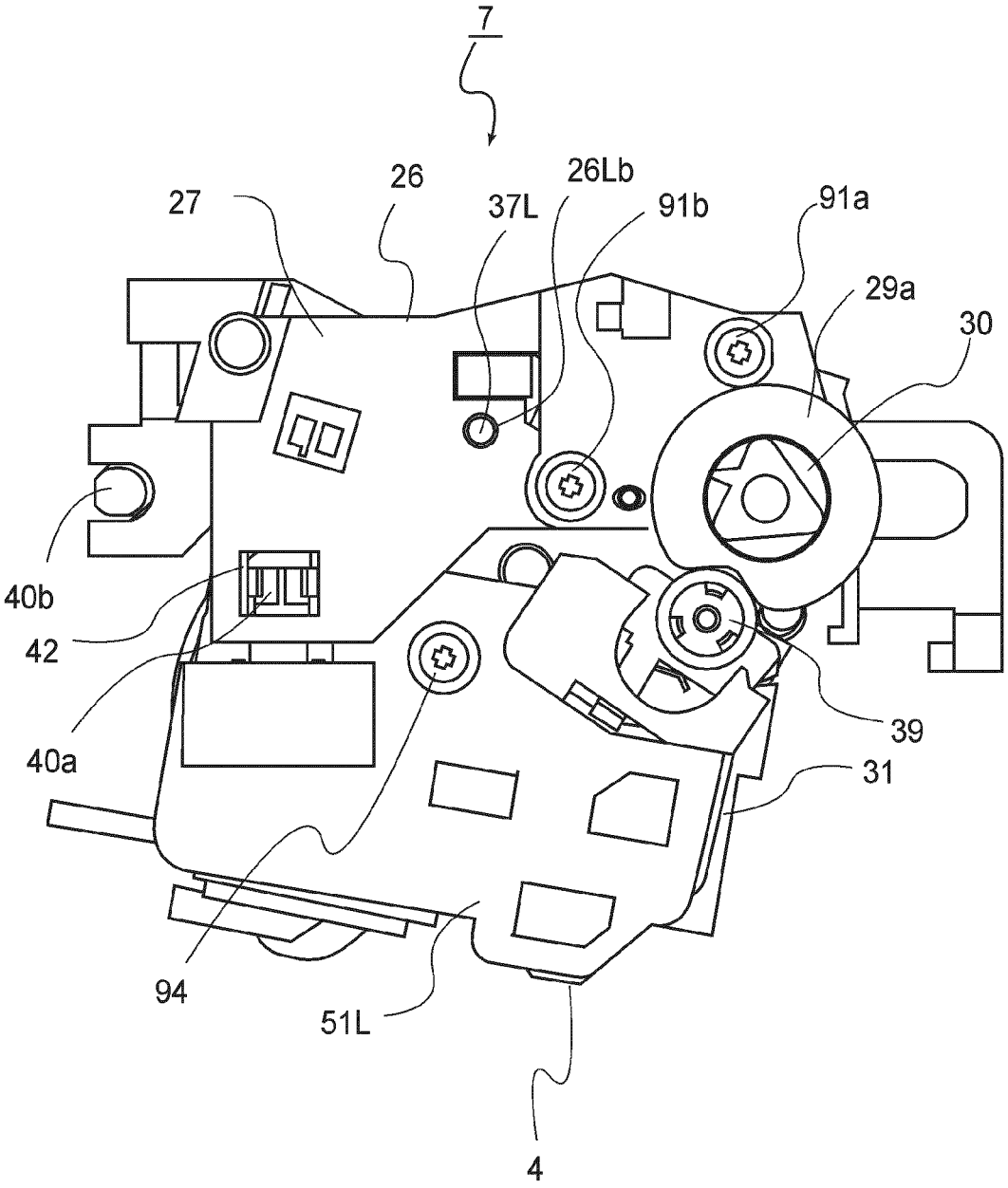
FIG. 5 is a side view of an end of the process cartridge according to the embodiment of the present invention.

Referring to FIG. 2 and FIG. 4, a general arrangement of the image forming apparatus will be described. This image forming apparatus 100 is a full-color four color laser beam printer which uses an electrophotographic process. It forms an image on a sheet-like recording material S on the basis of an electric image signal inputted to a control circuit portion (unshown) from an external host devices (unshown), such as a personal computer or an image reader. This image forming apparatus 100 is of a process cartridge mounting and dismounting type, and four cartridges 7 (first-fourth cartridges, 7*a*, 7*b*, 7*c*, 7*d*) are removably mounted to an apparatus main assembly 100*a*. The mounting and demounting of the cartridge 7 relative to the apparatus main assembly 100*a* is carried out by an operator. The operator opens an openable and closeable door 21 of the image forming apparatus 100 as shown in FIG. 4 to open a front side of the apparatus main assembly 100*a*. By this, the cartridges 7 are detachably mountable to the apparatus main assembly 100*a* independently from each other.

In a central portion of the apparatus main assembly 100*a*, cartridge mounting portions 22 (22*a*, 22*b* and 22*c*, and 22*d*) which are mounting means for the cartridges are obliquely juxtaposed relative to the horizontal direction. Each cartridge 7 is arranged in a mounting portion 22 with the longitudinal direction thereof aligned with a front-rear direction of the apparatus, and is inclined downwardly from the left to the right as seen from the front side of the image forming apparatus. Here, the cartridge 7 is elongated in a rotational axis direction of a photosensitive drum (photosensitive drum) 1. One (first) end and other (second) end of the cartridge 7 are the one end and the other end with respect to the rotational axis direction of a photosensitive drum 1. In other words, they are the one end and the other end with respect to the longitudinal direction of the photosensitive drum 1.

Each mounting portion 22 is provided with cartridge guide members 80 (80*a*, 80*b* and 80*c*, 80*d*) and 81 (81*a*, 81*b*, 81*c*, 81*d*). Each cartridge 7 is provided with members-to-be-guided 83, 84 for engaging with the guiding members 80, 81, respectively. Designated by reference numerals 85, 86 are portions-to-be-positioned of the cartridge in the mounting portion 22, and they are provided in said one end portion and the other end portion of the cartridge.

Each cartridge 7 dismountably mounted to the mounting portion 22 is provided with one photosensitive drum 1 (1*a*, (1*b*, (1*c*, 1*d*). The photosensitive drum 1 is rotated clockwisely in FIG. 2 by a motor (driving member, unshown). Around the photosensitive drum 1, the following process means actable on the photosensitive drum are provided in the order named along the rotational direction thereof. A cleaning member 6 (6*a*, 6*b* and 6*c*, and 6*d*) which is cleaning means for removing a developer (toner) which remains on a surface of the photosensitive drum after the transferring 1 is provided. A charging roller 2 (2*a*, 2*b*, 2*c*, and 2*d*) which is charging means for charging the photosensitive drum 1 surface uniformly is provided. A developing unit 4 (4*a*, 4*b* and 4*c*, and 4*d*) which is developing means for developing an electrostatic latent image with the toner is provided. A scanner unit 3 for projecting a laser beam on the basis of an image information and for forming an electrostatic latent image on the photosensitive drum 1 is provided, and in addition, an intermediary transfer belt 5 onto which a four color toner image is transferred all together from the photosensitive drum 1 is provided. Here, the photosensitive drum 1, the cleaning member 6, the charging roller 2, and the developing unit 4 are unified into a cartridge integrally to constitute the cartridge 7.

A transfer belt 5 is stretched around a driving roller 10 and a tension roller 11. In opposition to each photosensitive drum 1 and inside of the transfer belt 5, a primary transfer roller 12 (12*a*, 12*b* and 12*c*, and 12*d*) is provided. A transfer bias voltage is applied, by bias applying means (unshown), to the transfer belt 5. Each photosensitive drum 1 rotates in the direction of an arrow Q, and the transfer belt 5 rotates in the direction of the arrow R, and a bias voltage of the positive polarity is applied to the primary transfer roller 12. By this, the toner image formed on the photosensitive drum 1 is transferred on the transfer belt 5 sequentially (primary transfer). The four color toner image on the transfer belt 5 is fed to a secondary transfer portion 15.

In synchronism with such an image forming operation, a sheet S which is the recording material is fed by feeding means comprising a feeding device 13 and a registration roller pair 17 and so on. The feeding device 13 includes a cassette 24 for containing the sheet S, a feeding roller 8 for feeding the sheet S, and a conveying roller pair 16 for feeding the fed sheet S. The cassette 24 can be drawn out toward the front side in FIG. 2. The sheet S contained in the cassette 24 is press-contacted to the feeding roller 8, and the sheets is fed one by one with a separation pad 9 (friction piece separating type).

The sheet S fed from the feeding device 13 is fed to the secondary transfer portion 15 by the registration roller pair 17. In the transfer portion 15, a secondary transfer roller 18 is supplied with a bias voltage of the positive polarity. By this, the four color toner image is transferred from the transfer belt 5 onto the fed sheet S (secondary transfer).

In a fixing portion 14 which is fixing means, the heat and pressure are applied to the toner image formed on the sheet S to fix the toner image. A fixing belt 14*a* has a cylindrical shape, and it is guided by a belt guiding member (unshown) which is provided with heat generating means of the heater or the like. The fixing belt 14*a* and a pressing roller 14*b* constitute a fixing nip with a predetermined press-contact pressure. The sheet S which has an unfixed toner image fed from an image forming station is heated and pressed by the fixing nip between the fixing belt 14*a* and the pressing roller 14*b*. By this, the unfixed toner image on the sheet S is fixed on the sheet S. Thereafter, the sheet S which has the fixed toner image is discharged by a discharge roller pair 19 onto a discharging tray 20.

In addition, the toner which remains on the transfer belt 5 after the secondary transfer to the sheet S is removed by a belt cleaning device 23. The removed toner is collected into a residual toner recovery container (unshown) provided in an apparatus rear-side portion through a residual toner transportation path (unshown).

(Cartridge)

Figure 3:
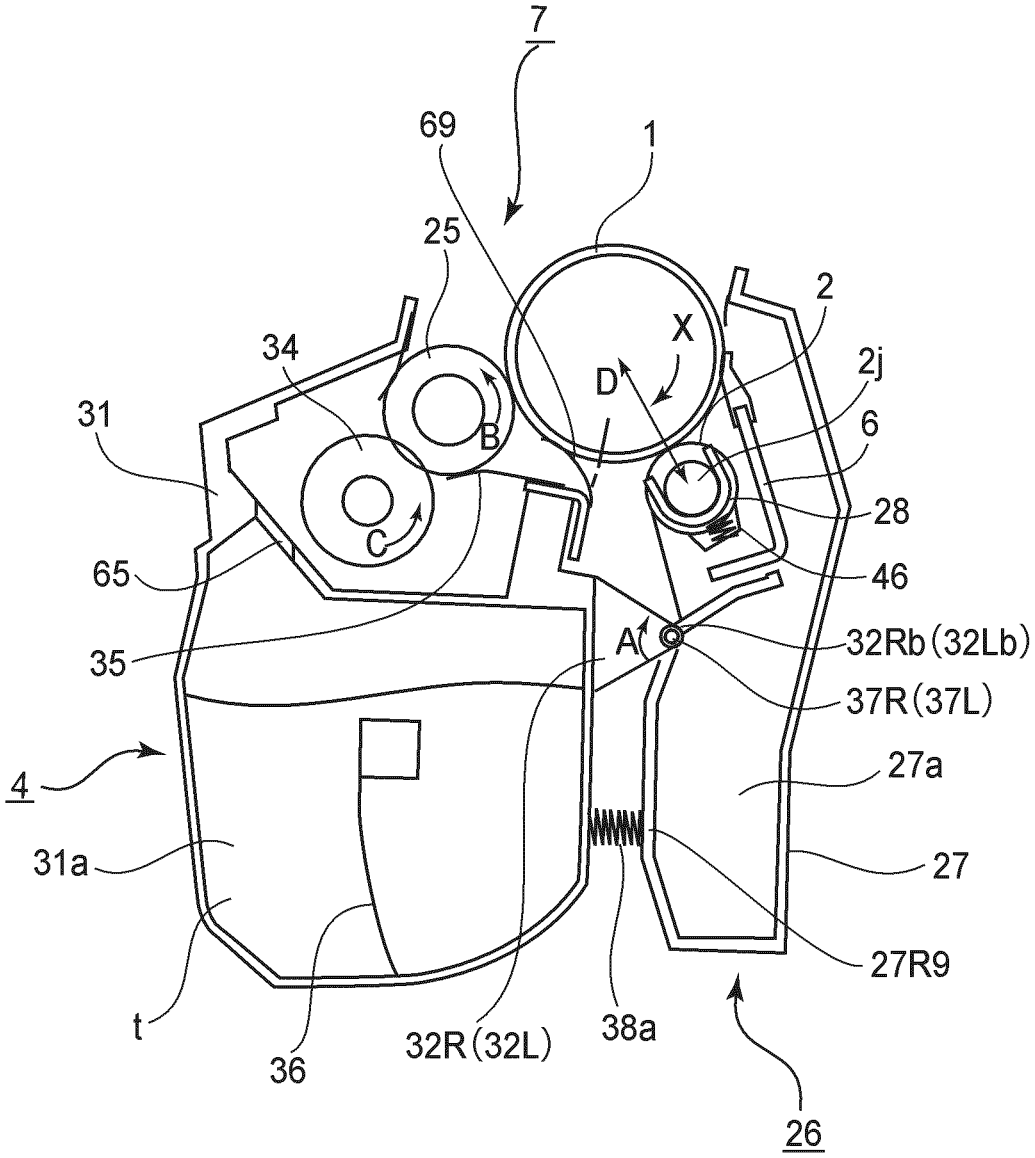
FIG. 3 is a sectional view of the cartridge.

Referring to FIG. 3, the description will be made as to the cartridge of the present embodiment. FIG. 3 shows a major section of the cartridge 7 which contains the toner t. Here, the cartridge 7*a* containing yellow toner t, the cartridge 7*b* containing magenta color toner t, the cartridge 7*c* containing cyan toner t, and the cartridge 7*d* containing black color toner t have the same structures.

The cartridge 7 is divided into a drum unit 26 (26*a*, 26*b*, 26*c*, 26*d*) which includes the photosensitive drum 1, the charging roller 2, and the cleaning member 6, and a developing unit 4 (4*a*, 4*b*, 4*c*, 4*d*) which includes the developing roller (developing means) 25.

To a cleaning frame 27 of the unit 26, the photosensitive drum 1 is rotatably mounted through bearings as will be described hereinafter. By transmitting a driving force (rotational force) from the driving motor (unshown) to a drum driving input portion 30 of the unit 26, the photosensitive drum 1 is rotated in response to the image forming operation. As has been described hereinbefore, the charging roller 2 and the cleaning member 6 are disposed on the outer periphery of the photosensitive drum 1. By the cleaning member 6, residual toner removed from the photosensitive drum 1 surface falls into a removed toner chamber (removed developer accommodating portion) 27*a*. The cleaning frame 27 is provided with charging roller bearings 28, which are movable in the direction of an arrow D passing through a rotational center of the charging roller 2 and the center of the rotational photosensitive drum 1. The shaft 2*j* of the charging roller 2 is rotatably supported on the bearings 28. The bearing 28 is urged by a charging roller pressing member 46 toward the photosensitive drum 1.

The unit 4 includes the developing roller 25 rotatable in the direction of the arrow B in contact with the photosensitive drum 1, and includes a developing device frame 31. The developing roller 25 is rotatably supported by the developing device frame 31 through bearing members mounted at each longitudinal end of the developing device frame 31. Onto the periphery of the developing roller 25, a toner supplying roller 34 (34*a*, 34*b* and 34*c*, 34*d*) as the developer supplying roller rotatable in the direction of the arrow C, and a developing blade 35 for regulating a toner layer on the developing roller 25, are contacted. A toner accommodating portion (developer accommodating portion) 31*a* of the developing device frame 31 is provided with a toner feeding member 36 for feeding the toner to the toner supplying roller 34, while stirring the contained toner.

The unit 4 is connected to the drum unit 26 rotatably about an axis of the shaft 37 (37R, 37L) which engages with the holes 32Rb, 32Lb provided in bearing members 32 (32R and 32L). The unit 4 is urged by a pressing spring 38. Therefore, during an image forming operation of the cartridge 7, the unit 4 rotates in the direction of the arrow A about the shaft 37, and is contacted to the photosensitive drum 1. According to this embodiment, the developing roller 25 develops the electrostatic latent image formed on the photosensitive drum 1 in the state of contacting to the photosensitive drum 1. In other words, a so-called contact type developing system is used.

Referring to FIG. 1, FIG. 3, and FIGS. 5-10, the cartridge 7 will be further described.

Figure 1:
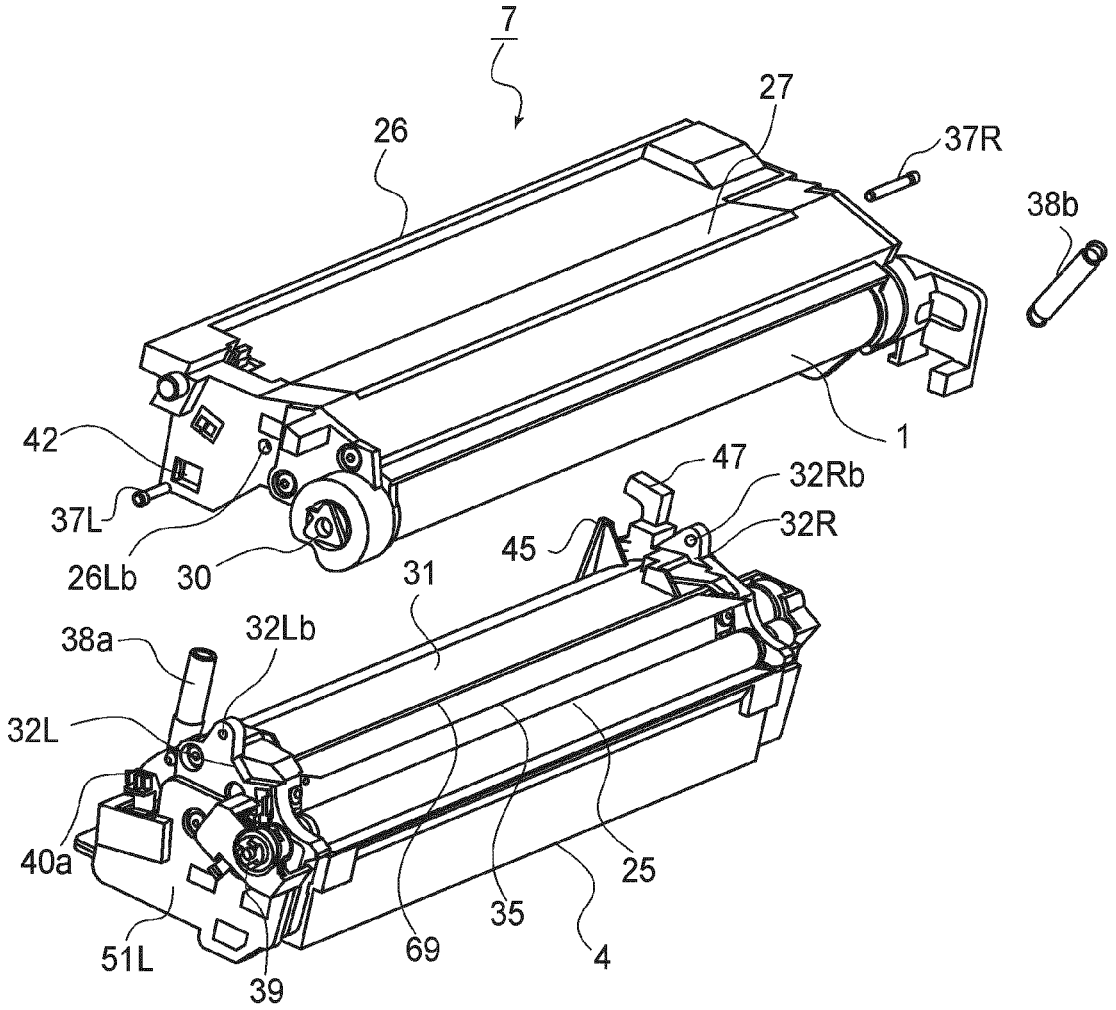
FIG. 1 is an exploded perspective view of a process cartridge according to an embodiment of the present invention.
Figure 6:
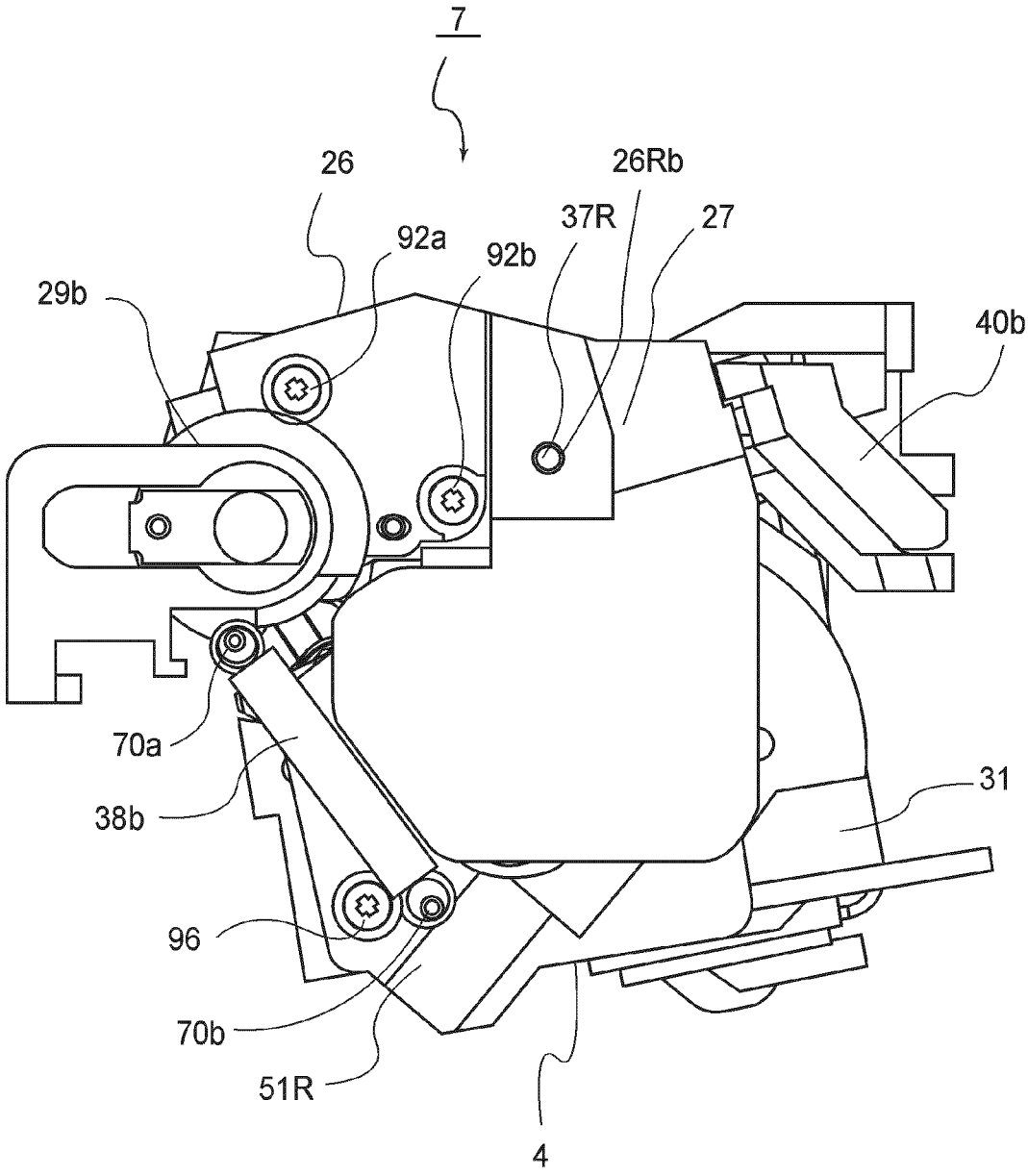
FIG. 6 is a side view of the other end of the process cartridge according to the embodiment of the present invention.
Figure 7:
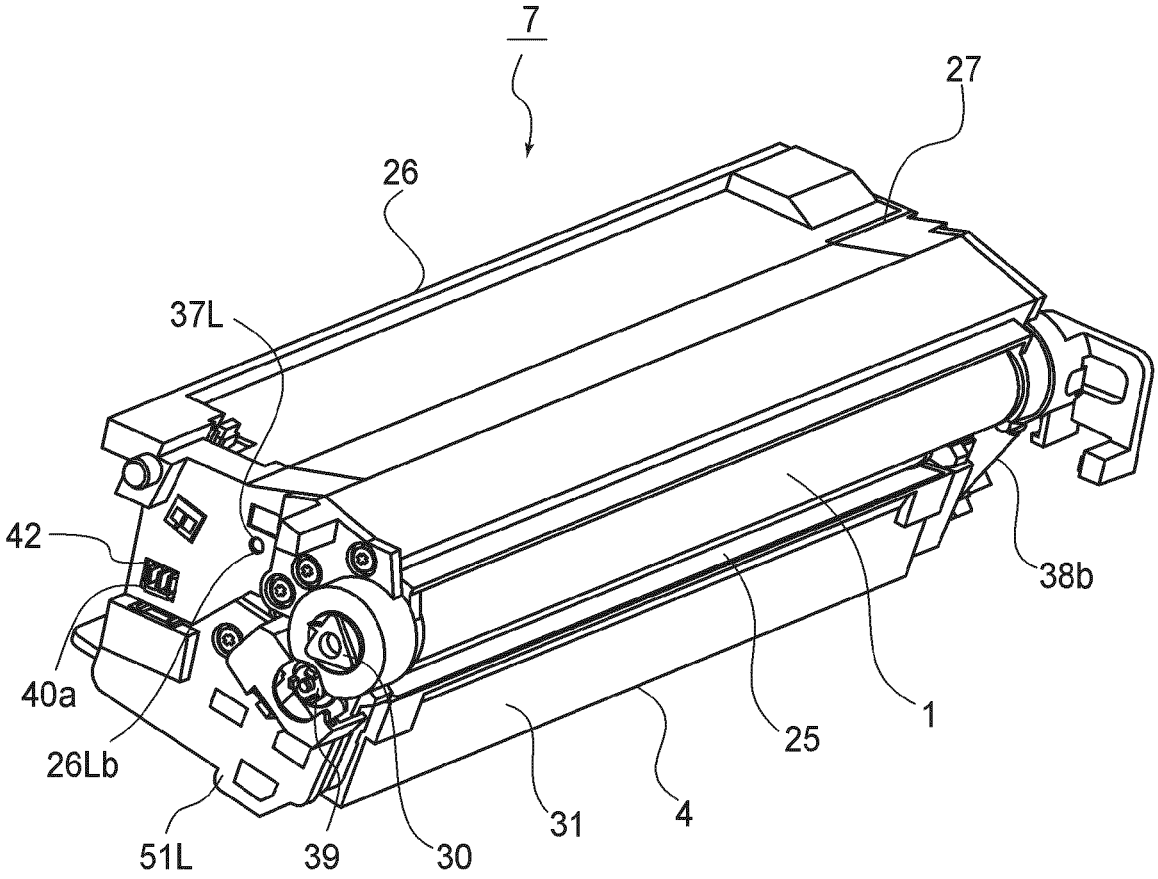
FIG. 7 is a perspective view of the process cartridge according to the embodiment of the present invention.

A pressing spring 38*a* provided at the one-end portion is disposed in the side opposite from the photosensitive drum 1 with respect to the shaft 37 which is the center of a rotation of the developing unit 4 relative to the drum unit 26, and it is a compression spring effective for pressing the unit 26 and the developing unit 4 to each other. A pressing spring 38*b* provided in the other end side is a tension spring provided in the neighborhood of the developing roller 25 of the unit 4 and in the neighborhood of the photosensitive drum 1 of the unit 26 (FIG. 1). This tension spring 38*b* is stretched between bosses (mounting portions) 70 (70*a* and 70*b*) which are provided in each of the other ends of the drum unit 26 and the developing unit 4 (FIG. 6).

Figure 8:
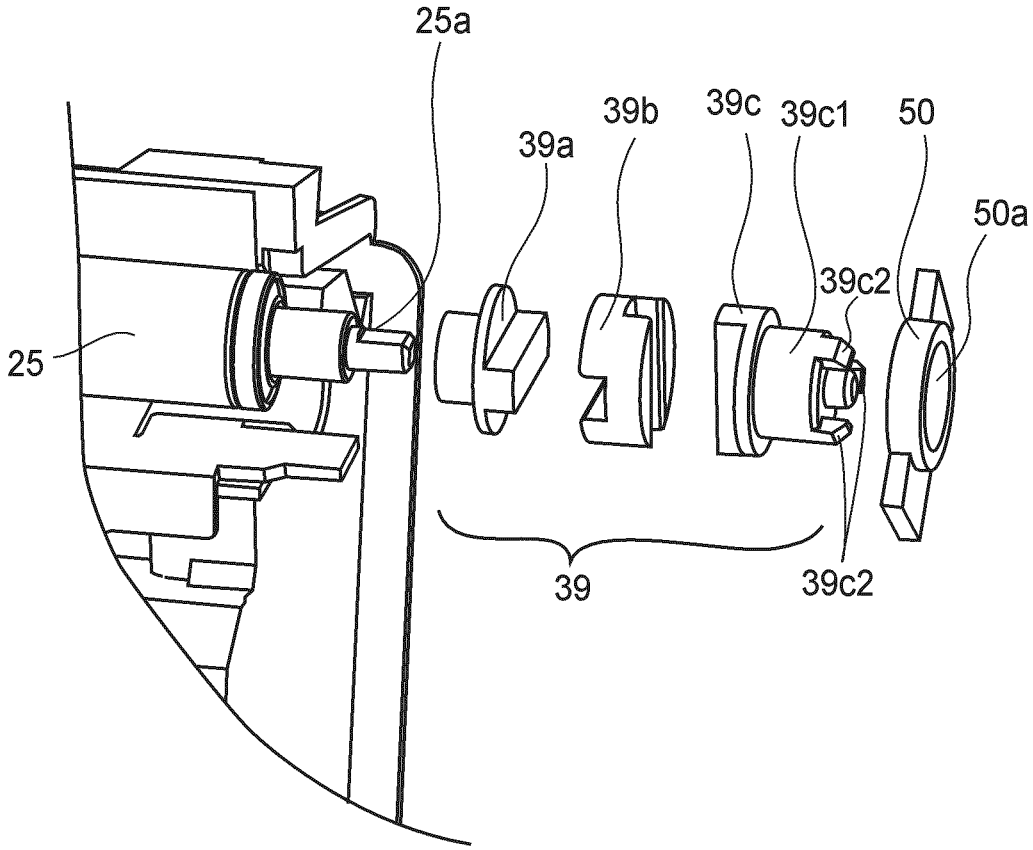
FIG. 8 is a perspective view illustrating a development drive input portion of the process cartridge according to the embodiment of the present invention.
Figure 9:
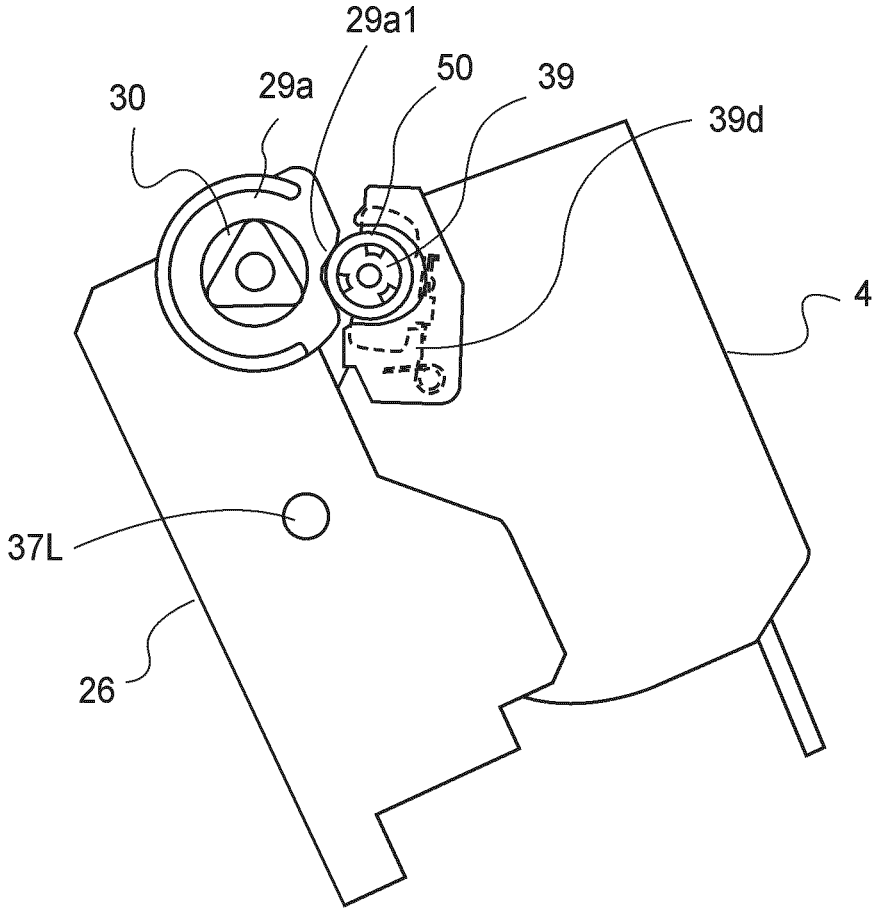
FIG. 9 is a side view illustrating the development drive input portion of the process cartridge according to the embodiment of the present invention.
Figure 10:
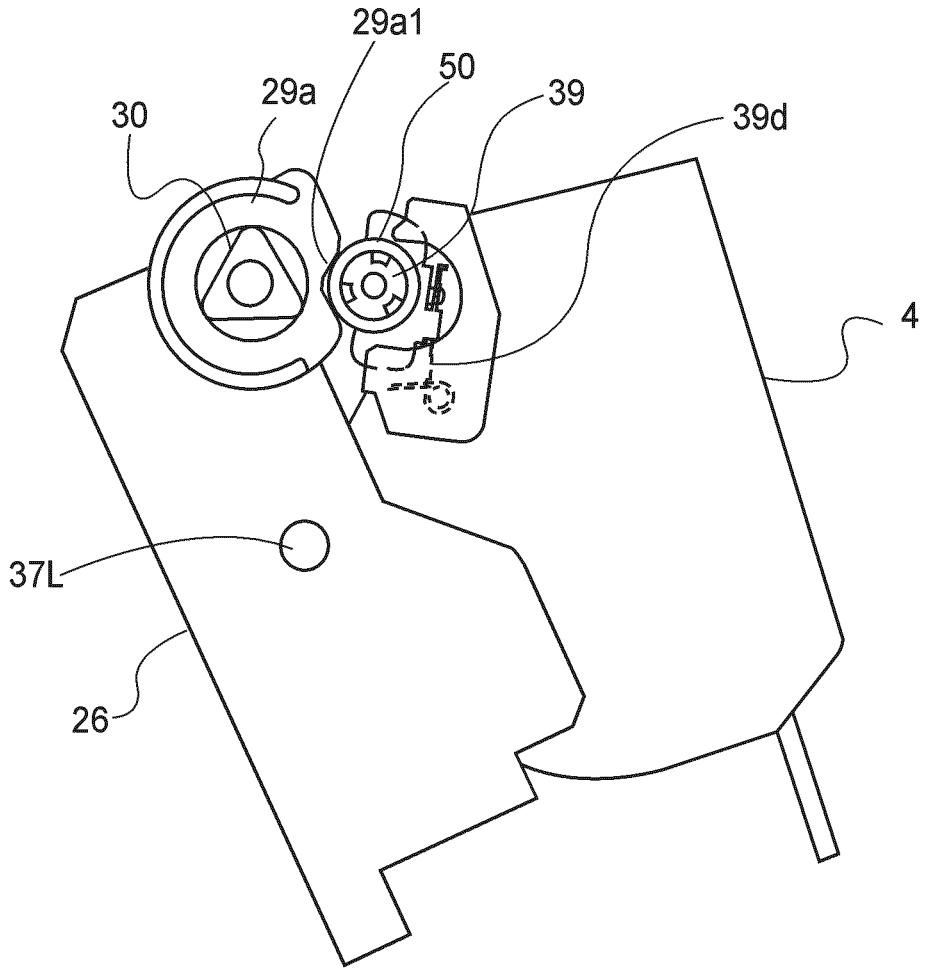
FIG. 10 is a side view illustrating the development drive input portion of the process cartridge according to the embodiment of the present invention.

As a rotation input portion for the developing roller 25, an Oldham coupling 39 which is a shaft coupling member is employed. Referring to FIGS. 8-10, the Oldham coupling 39 comprises a driven side engaging portion 39*a*, an intermediary engaging portion 39*b*, and a driving side engaging portion 39*c*. Here, an engaging portion 39*a* is mounted fixedly to the end of the one end shaft (one-end roller shaft) 25*a* of the developing roller 25. The engaging portion 39*c* is rotatably retained by an engaging portion bearing member 50. The bearing member 50 is urged toward the photosensitive drum 1 by an urging spring 39*d*, and contacts to a V-shaped recess 29*a*1 of a drum bearing member 29*a* to place the engaging portion 39*c* in the predetermined position. The engaging portion 39*c* is provided integrally with a projection 39*c*2 for engaging with a drive transmitting portion (unshown) of the apparatus main assembly 100*a*. A coupling 39 is swingably mounted to the unit 4, while a deviation between a main assembly side drive transmitting portion and the axis of the developing roller 25 is permitted, a rotational driving force from the apparatus main assembly 100*a* is transmitted to the developing roller 25. The coupling 39 can transmit the rotational force from the apparatus main assembly 100*a* to the developing roller 25, in the position of the unit 4 at the time of the developing roller 25 contacting with the photosensitive drum 1, and in the position of the unit 4 at the time of the developing roller 25 spacing with the photosensitive drum 1.

The unit 4 is provided with a photosensitive drum contact sheet 69 which has flexibility and which is contacted to the photosensitive drum 1. The sheet 69 is contacted to the photosensitive drum 1 (FIG. 3), with codirectional bending with respect to the rotational direction of the photosensitive drum 1. This prevents the scattering of the toner to the exterior from the cartridge 7. Even in the case where the toner leaks from a neighborhood of the developing roller 25 and so on. In other words, a space is defined by the sheet 69, the developing blade 35, the developing roller 25, and the photosensitive drum 1, the toner is stored in this space. Here, the photosensitive drum contact sheet 69 is made of polyester film, for example, and is mounted with the double coated tape and so on to the developing blade 35.

The cartridge 7 has a developing device spacing member 40 (40*a* and 40*b*), in order to maintain a spacing state between the photosensitive drum 1 and the developing roller 25 at the time of intact. Furthermore, the cartridge 7 has a charger spacer 41 (41*a* and 41*b*), in order to maintain the spaced state between the photosensitive drum 1 and the charging roller 2 before start of use of the cartridge. Referring to FIGS. 11-21, the developing device spacing and the charger spacing will be described.

Figure 11:
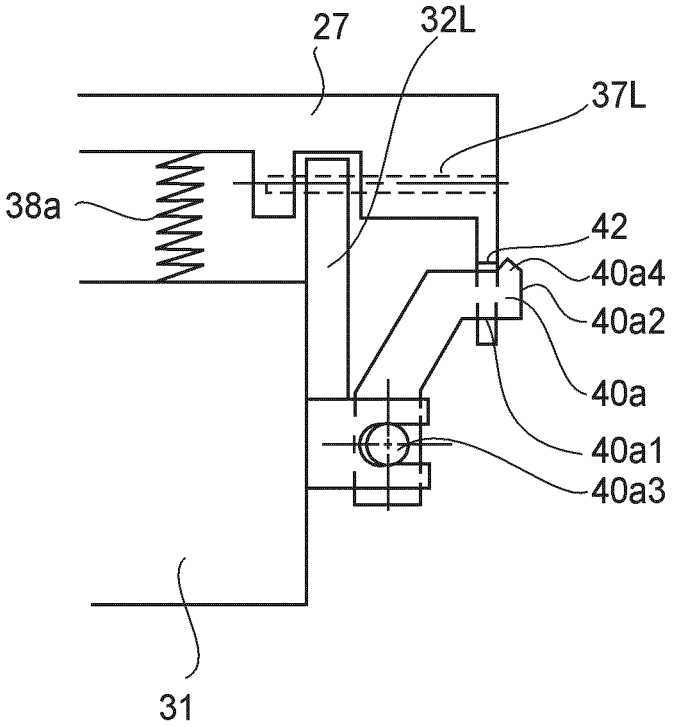
FIG. 11 is a schematic view illustrating a developing device separation structure at an end of the process cartridge according to the embodiment of the present invention.

The unit 4 is rotatable around the axis of the shaft 37 (37L and 37R), and the developing roller 25 is normally contacted to the photosensitive drum 1 by an urging force of pressing spring 38 (38*a* and 38*b*). A first developing device spacing member 40*a* is supported at the one-end portion of the developing unit 4 (FIG. 11, FIG. 12) rotatably about a rotation axis of the shaft 40*a*3. At the time of effecting a developing device spacing in the one-end portion, an engaging surface 40*a*1 of a spacer member 40*a* is engaged with a developing device spacing opening (one-end engaging portion) 42 provided at the one-end portion of the drum unit 26. By this, in the one-end portion of the unit 4, the rotation is limited, and the unit 4 is retained in the spacing state in which the developing roller 25 spaces from the photosensitive drum 1 against the urging force of a compression urging spring 38*a*. In addition, the spacer member 40*a* is provided with an engaging projection 40*a*4 to prevent the unintended releasing from an opening 42. At the time of effecting the developing device spacing, the projection 40*a*4 elastically bends and passes the opening 42 to engage with the edge of the opening 42 (FIG. 11). In the case of the releasing of the developing device spacing, the projection 40*a*4 elastically bends and pass the opening 42 in the direction opposite from said direction to disengage from the edge of the opening 42.

Figure 13:
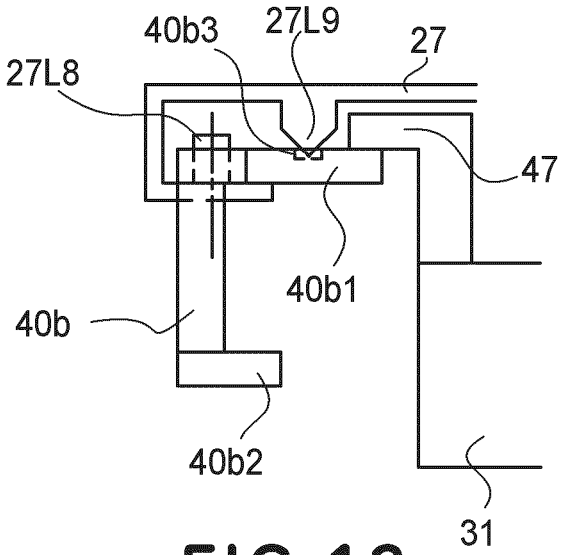
FIG. 13 is a schematic view illustrating the developing device separation structure at the other end of the process cartridge according to the embodiment of the present invention.
Figure 14:
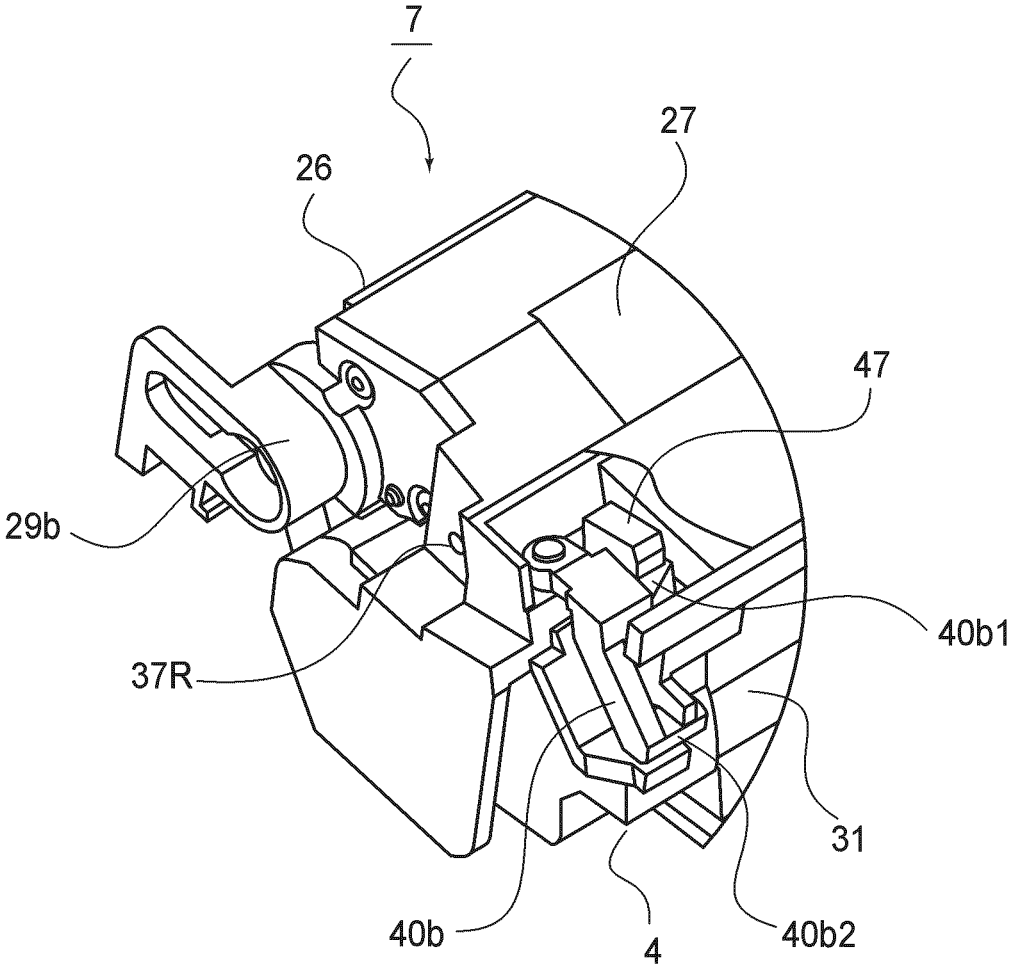
FIG. 14 is a perspective view illustrating the developing device separation structure at the other end of the process cartridge according to the embodiment of the present invention.

The second developing device spacing member 40*b* is supported at the other end portion of the unit 26 (FIG. 13, FIG. 15) rotatably about the rotation axis of the shaft 27L8. At the time of effecting the developing device spacing at the other end portion, the spacer member 40*b* is rotated. The engaging portion 40*b*1 is engaged, through the cleaning frame 27, with a developing device spacing projection (the other end engaging portion) 47 provided at the other end portion of the developing unit 4. By this, in the other end portion of the unit 4, the rotation is restricted, and the unit 4 is retained in the state in which the developing roller 25 spaces from the photosensitive drum 1 against the urging force of the tension spring 38*b*. The cleaning frame 27 is provided with an engaging projection 27L9, and when the spacer member 40*b* is in an engaged state, the engaging projection 27L9 engages with an engaging groove 40*b*3 of the spacer member 40*b*, so that the unintended releasing does not occur. At the time of effecting the developing device spacing, the engaging portion 40*b*1 elastically bends to engage with the projection 47 (FIG. 13). In the case of the releasing the developing device spacing, the engaging portion 40*b*1 elastically bends to disengage from the projection 47.

With respect to a mounting direction in which the cartridge 7 is mounted to the apparatus main assembly 100*a*, the spacer member 40*a* is provided at a leading end of the unit 4, and the one-end engaging portion 42 is provided at the leading end of the unit 26. The spacer member 40*b* is provided at a trailing end of a unit 26, and the other end engaging portion 47 downwardly projects in a trailing end of the unit 4, in the state in which the cartridge 7 is set in place in the apparatus main assembly.

Figure 17:
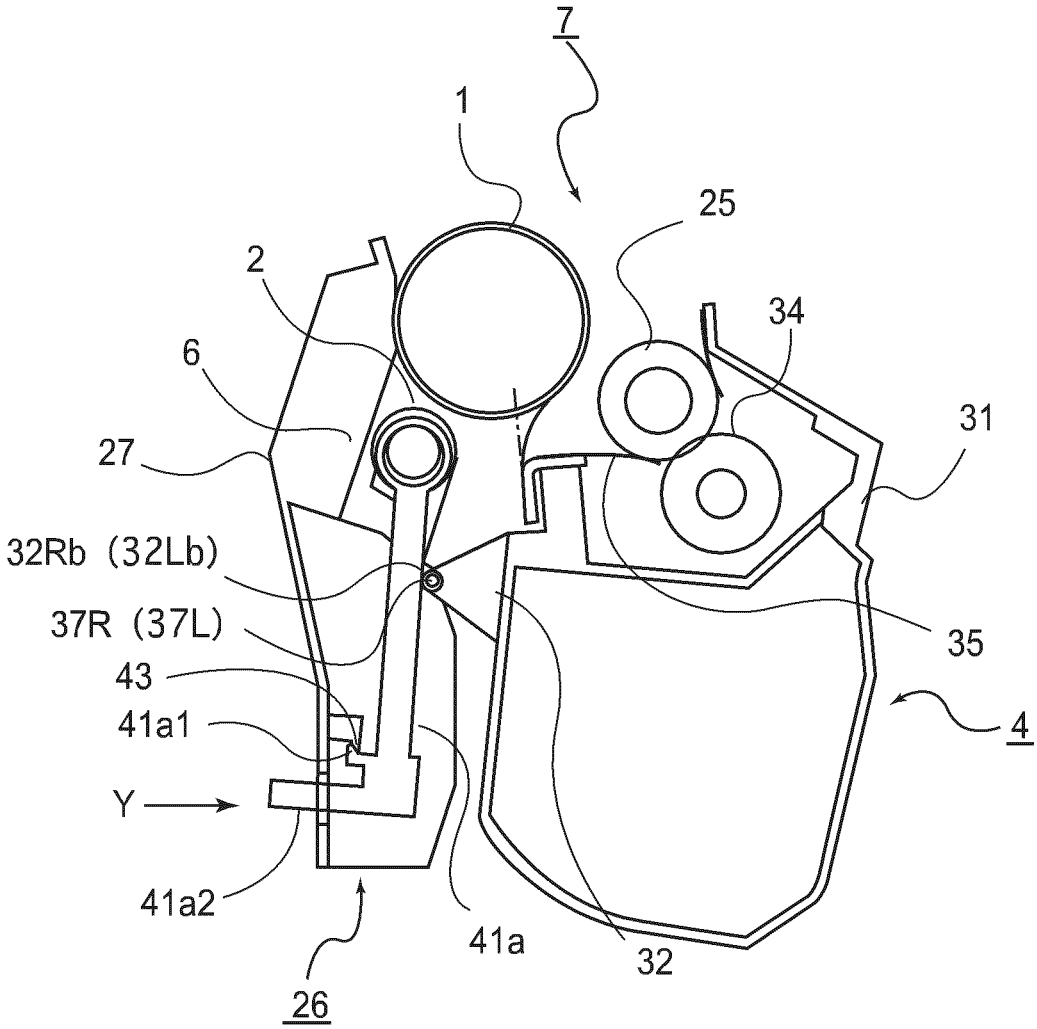
FIG. 17 is a side view illustrating a charger spacing structure at the end of the process cartridge according to the embodiment of the present invention.
Figure 18:
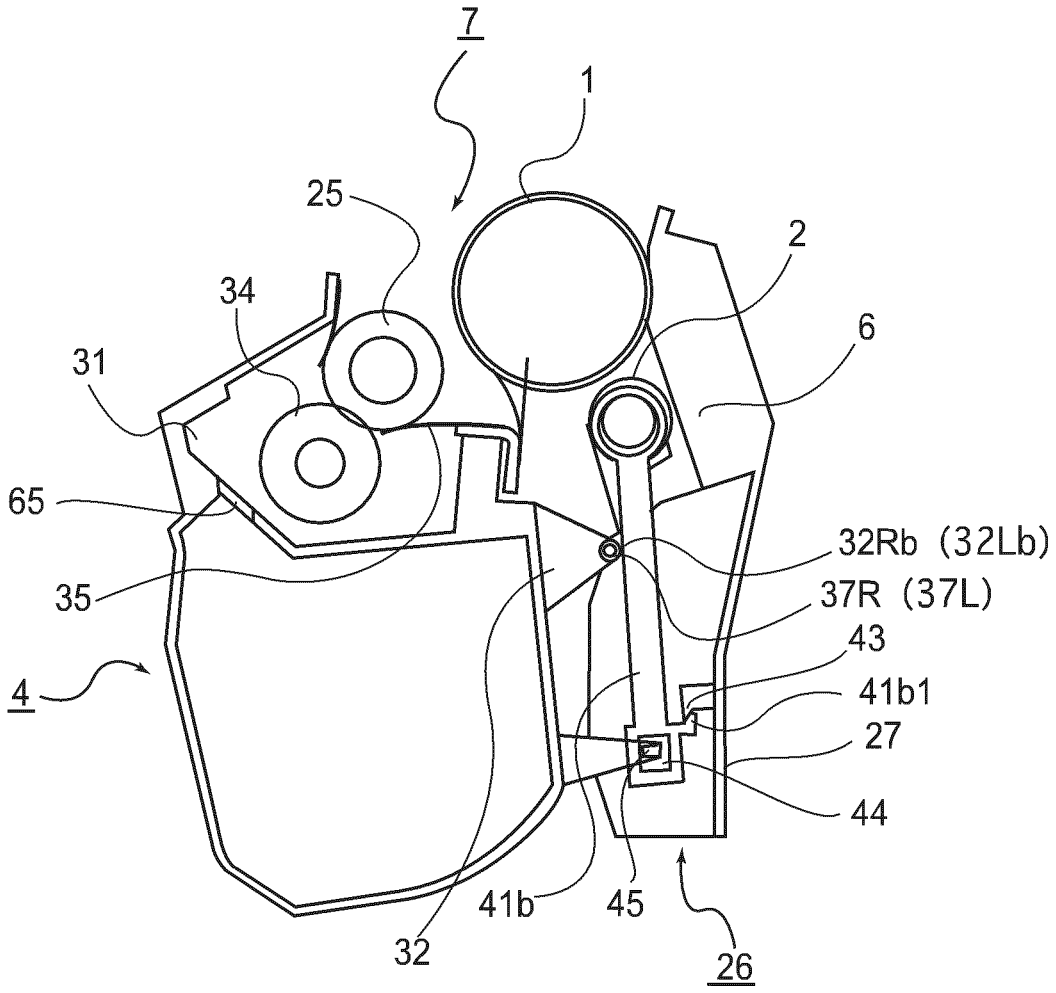
FIG. 18 is a side view illustrating the charger spacing structure at the other end of the process cartridge according to the embodiment of the present invention.
Figure 19:
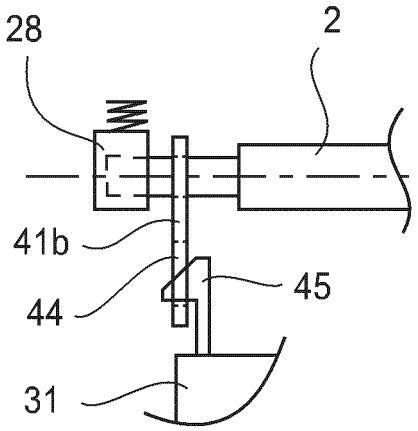
FIG. 19 is a schematic view illustrating the charger spacing structure at the other end of the process cartridge according to the embodiment of the present invention.

The charger spacer 41 (41*a* and 41*b*) is rotatably supported at each of opposite ends of the charging roller 2 (FIG. 17 and FIG. 18). At the time of effecting retention of a charger spacing, the spacer member 41 pulls the charging roller 2 against the urging force toward the photosensitive drum 1 so as to engage an engaging claw 41*a*1, 41*b*1 of the spacer member 41 with a charger spacing pawl 43 provided at the end of the unit 26. The spacer member 41 has an opening 44 for releasing the charger spacing. A charger spacing releasing claw 45 provided on the developing unit 4 is in engagement with the opening 44 (FIG. 19).

Figure 12:
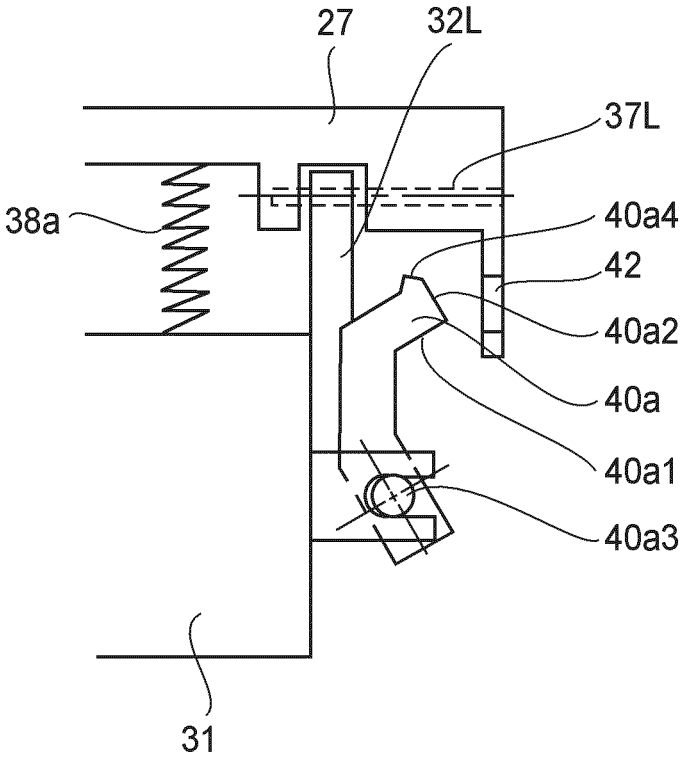
FIG. 12 is a schematic view illustrating the developing device separation structure at the end of the process cartridge according to the embodiment of the present invention.
Figure 15:
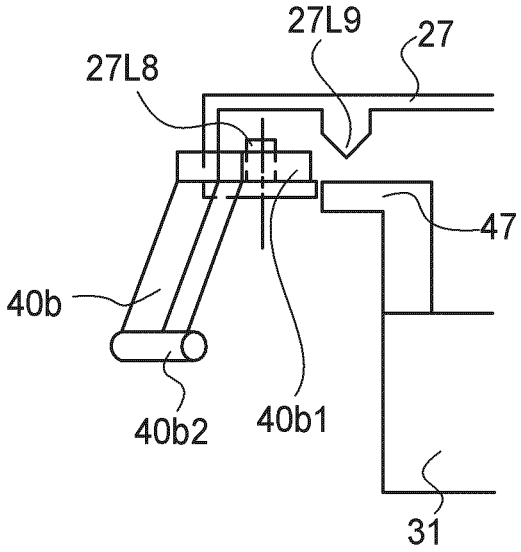
FIG. 15 is a schematic view illustrating the developing device separation structure at the other end of the process cartridge according to the embodiment of the present invention.
Figure 16:
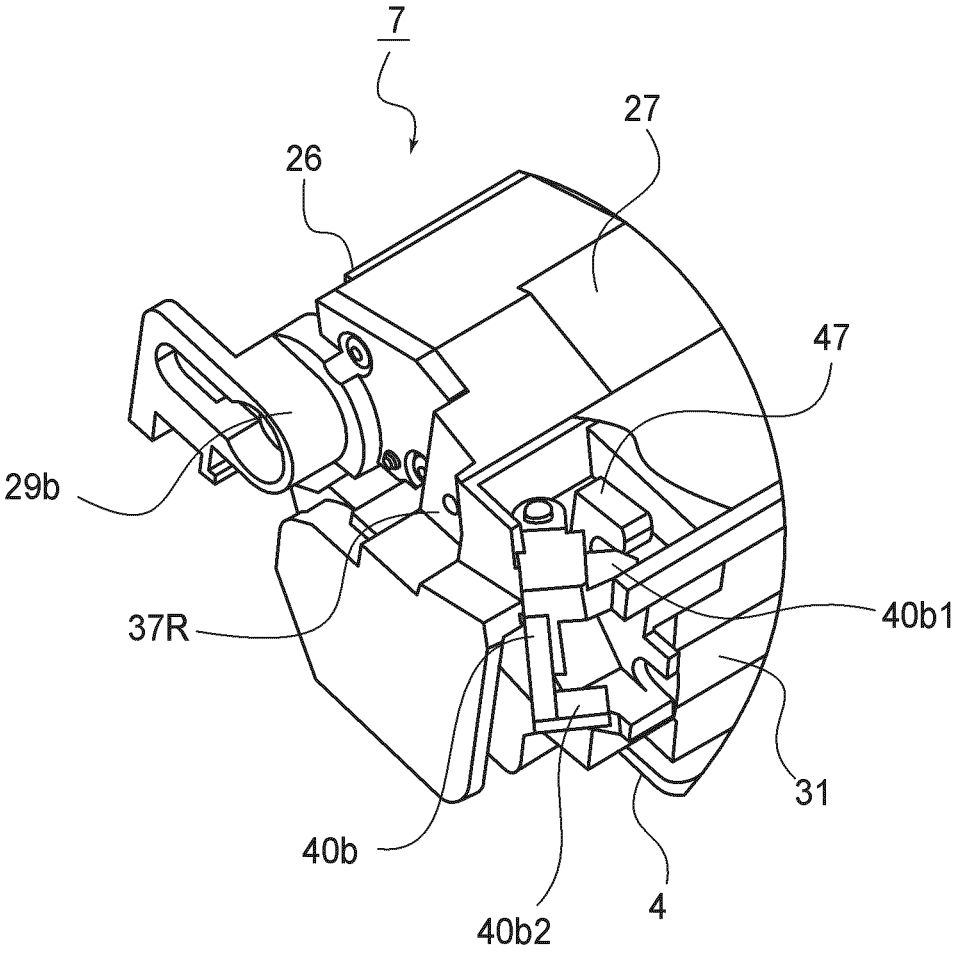
FIG. 16 is a perspective view illustrating the developing device separation structure at the other end of the process cartridge according to the embodiment of the present invention.

Next, the releasing of the developing device spacing and the charger spacing will be described. In the releasing of the developing device spacing, when the cartridge 7 is mounted to the apparatus main assembly 100*a*, a releasing projection (unshown) provided in the apparatus main assembly pushes portions-to-be-urged 40*a*2, 40*b*2 of the developing device spacing members 40*a*, 40*b* thereby to rotate it. The disengagement is done by this rotation (FIG. 12, FIG. 15, and FIG. 16).

Figure 20:
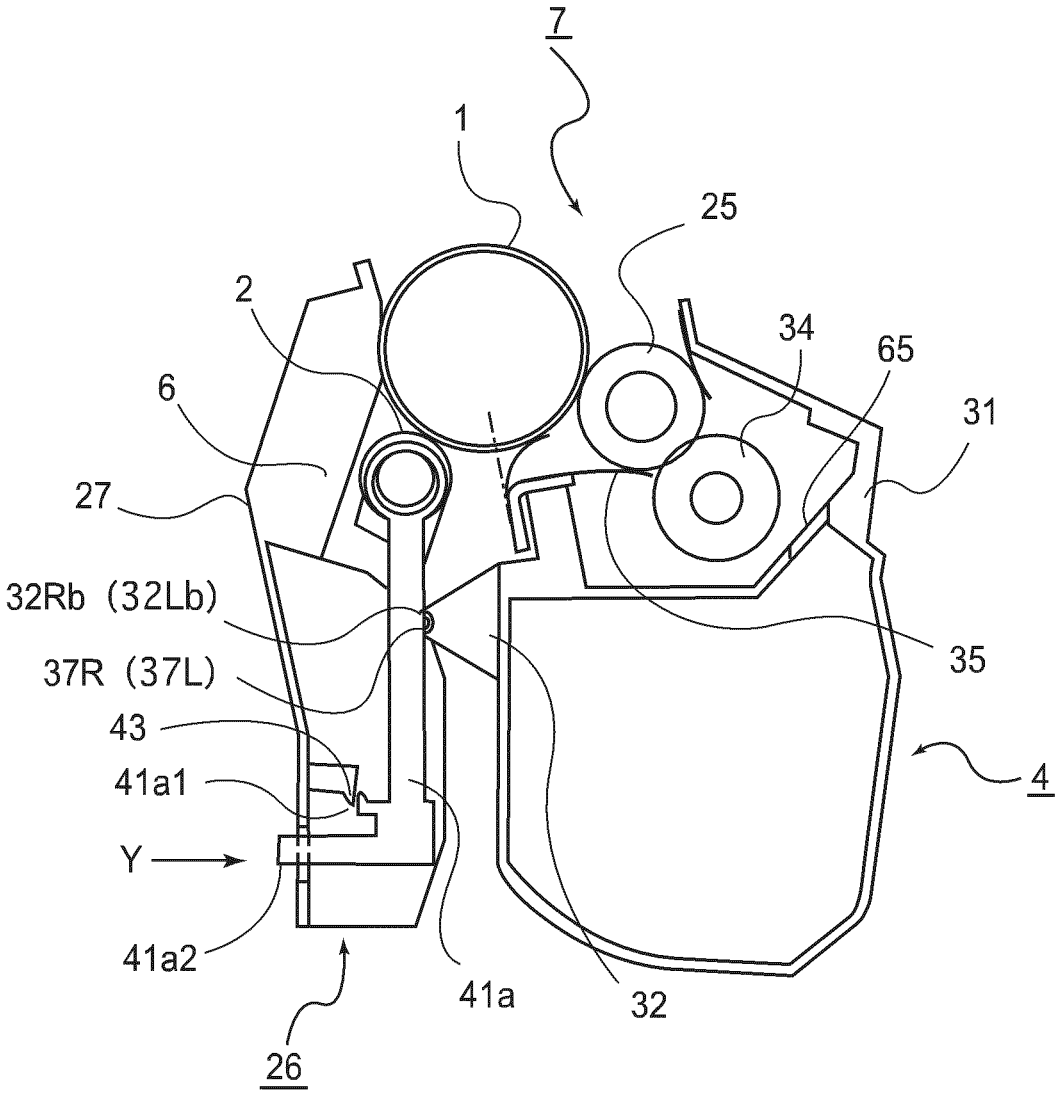
FIG. 20 is a side view illustrating the charger spacing structure at the end of the process cartridge according to the embodiment of the present invention.
Figure 21:
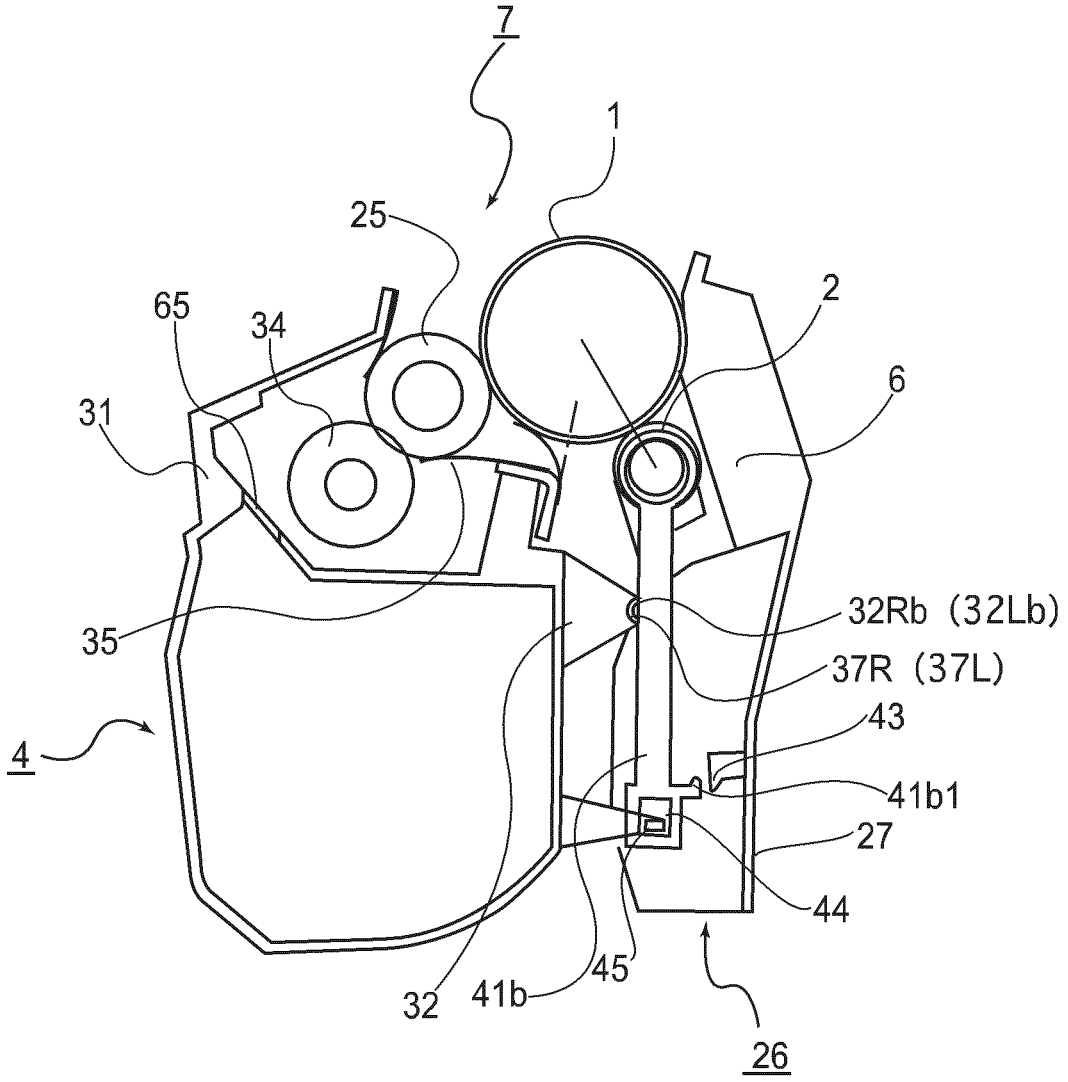
FIG. 21 is a side view illustrating the charger spacing structure at the other end of the process cartridge according to the embodiment of the present invention.
Figure 22:
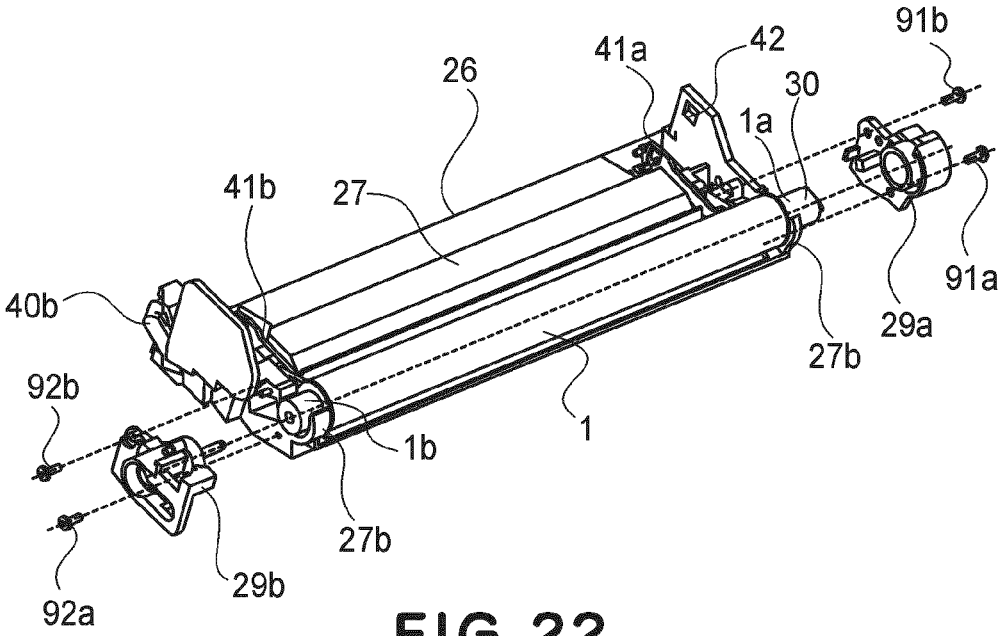
FIG. 22 is an exploded perspective view of a drum unit of the process cartridge according to the embodiment of the present invention.
Figure 23:
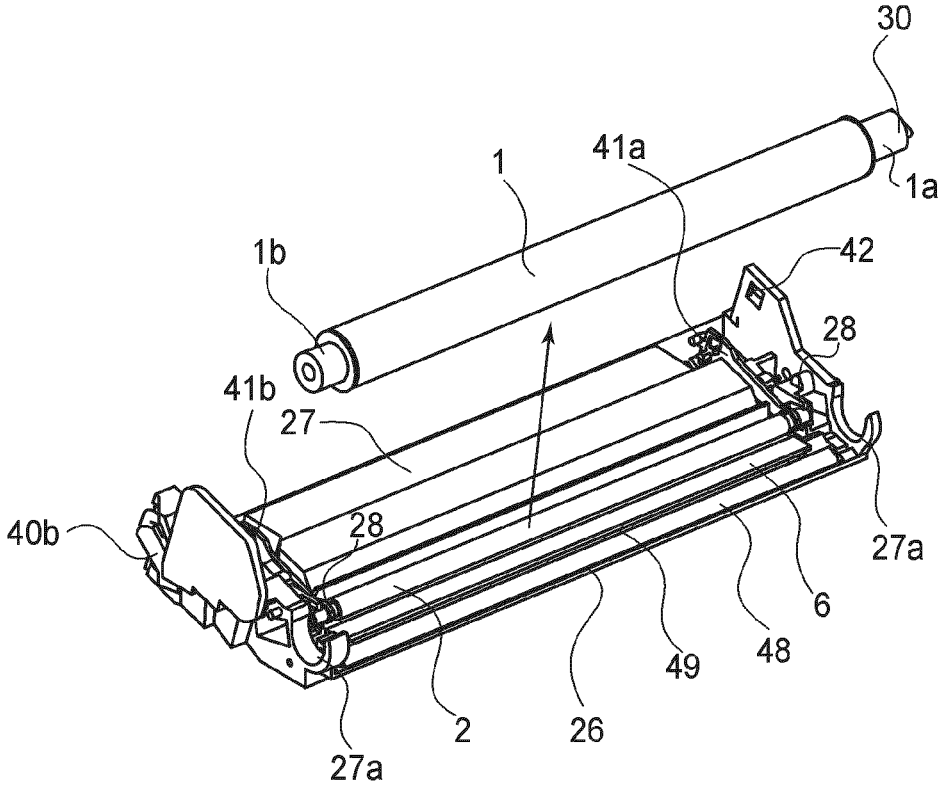
FIG. 23 is an exploded perspective view of the drum unit of the process cartridge according to the embodiment of the present invention.
Figure 24:
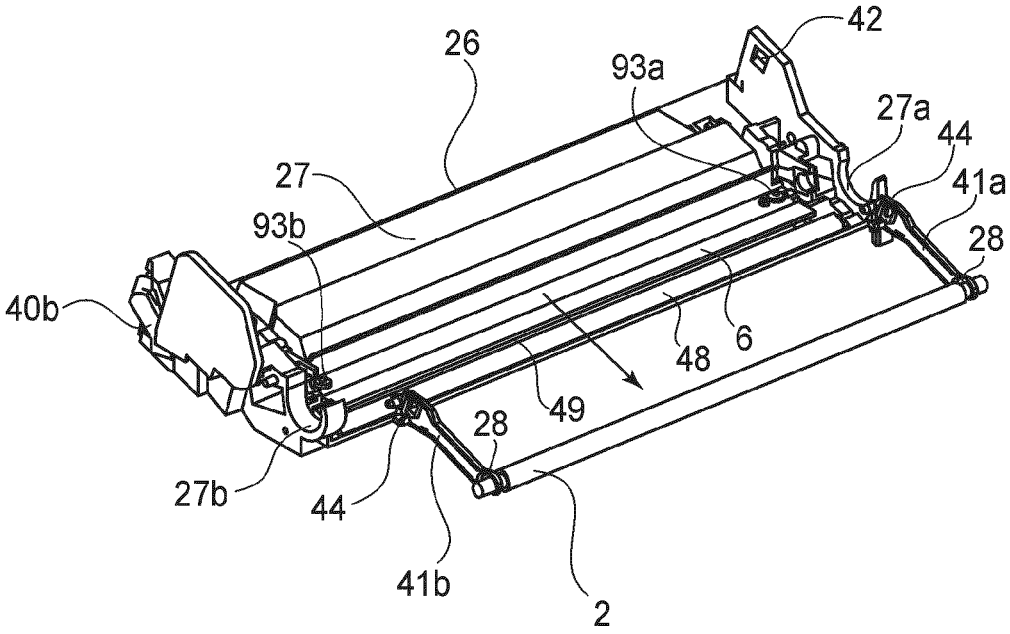
FIG. 24 is an exploded perspective view of the drum unit of the process cartridge according to the embodiment of the present invention.
Figure 25:
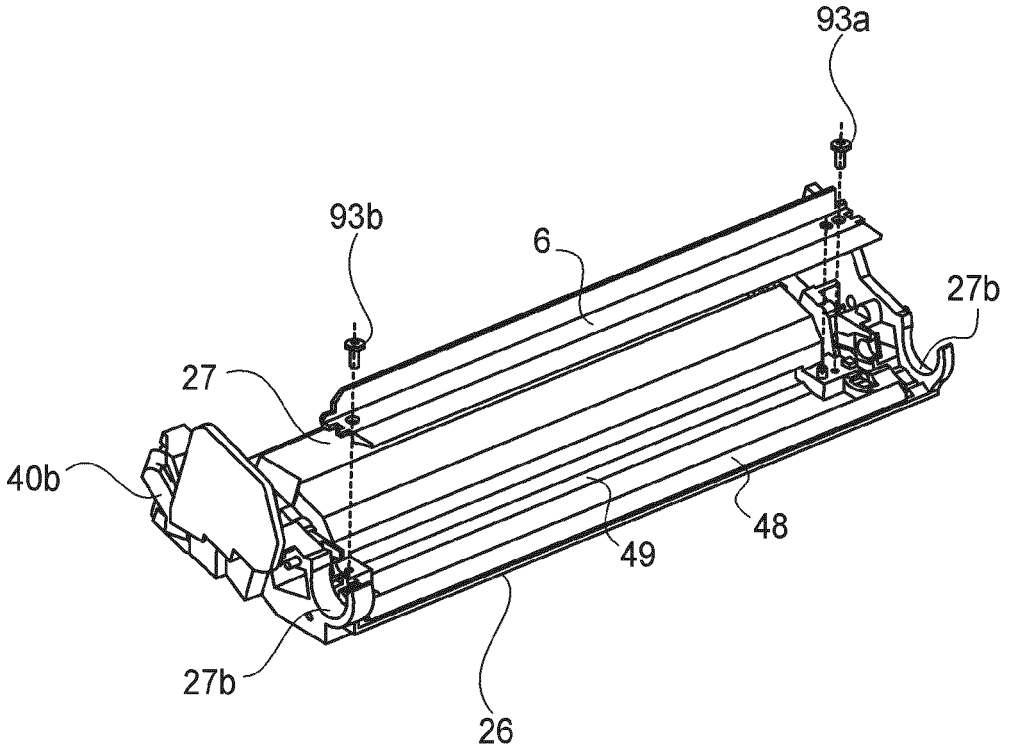
FIG. 25 is an exploded perspective view of the drum unit of the process cartridge according to the embodiment of the present invention.

The releasing of the other end charging spacing is carried out, at the time of releasing the developing device spacing, after the cartridge 7 is mounted to the apparatus main assembly 100*a*. In other words, at this time, a releasing claw 45 engaged with the opening 44 of the spacer member 41*b* pulls the spacer member 41*b*. By this, the disengagement between the engaging claw 41*b*1 of the spacer member 41*b* and the charger spacing pawl 43 is done. In other words, the releasing of the charger spacing at the other end portion is accomplished (FIG. 21). On the other hand, in said one-end portion, in the state in which the cartridge 7 is set in the apparatus main assembly 100*a*, a spacing releasing member (unshown) of the apparatus main assembly 100*a* pushes the portion-to-be-urged for the charger spacer 41*a*2 in the direction of an arrow in FIG. 17 and FIG. 20Y. The disengagement between the engaging claw 41*a*1 of the spacer member 41*a* and a spacing pawl 43 is done by this push, so that the charger spacing releasing is accomplished (FIG. 20).

(Remanufacturing Method for Cartridge)

In the cartridge 7 mounted to the apparatus main assembly 100*a*, the developer (toner) t contained in the toner accommodating portion 31*a* is consumed in accordance with the repetition of the image formation. And, when the toner is consumed to the extent that it is impossible to form the image of the quality which can satisfy the user of the cartridge, it is unusable. For example, means (unshown) for sensing the developer remainder in the cartridge 7 is provided, and the detected remaining amount value is compared with the threshold for a cartridge lifetime fore notice or cartridge lifetime warning which is set beforehand, in a main assembly control circuit (unshown). When the detected remaining amount value becomes less than the threshold, the lifetime fore notice or the lifetime warning of the cartridge is displayed on a display portion (unshown). By this, the user is prompted to a preparation of an exchange cartridge or to the exchange of the cartridge in order to maintain the quality of an output image.

The used cartridge is collected, and it is subjected to cleaning, parts replacement and so on, and is supplied with a fresh developer, by which it is reproduced or refreshed. A remanufacturing method for the used cartridge will be described.

Air suction, a blowing, a wet type cleaning, and a wiping and so on are used in the cleaning.

<i> Unit Separating Step

Referring to FIG. 1, the description will be made as to the unit separating step for separating the unit 26 and the unit 4 from each other.

The tension spring 38*b* which elastically urges the developing roller 25 to the photosensitive drum 1 is demounted. In the case where the spacer member 40*a* is in engagement with the developing device spacing opening 42 in (FIG. 11), the portion-to-be-urged 40*a*2 is pressed. By doing so, this is released (FIG. 12). Then, in the case where the spacer member 40*b* of the other end portion is in engagement with the developing device spacing projection 47 in (FIG. 13 and FIG. 14), the portion-to-be-urged 40*b*2 is pressed. By doing so, this is released (FIG. 15 and FIG. 16).

Subsequently, the shaft (pin) 37 (37L, 37R) which rotatably connects the unit 26 and the unit 4 with each other is pulled out.

By the above-described steps, all disengagements between the unit 26 and the developing unit 4 are done, and the unit 26 and the unit 4 become separable from each other.

<ii> Disassembling, Cleaning, Parts Replacement, Re-Assembling of the Unit

Referring to FIGS. 22-25, the description will be made as to the disassembling, the cleaning, the parts replacement, and the re-assembling of the unit 26 after separating the unit 26.

The photosensitive drum 1 is held through the one end drum bearing 29*a* and the other end drum bearing 29*b* which are photosensitive drum bearings provided in the unit 26 (the cleaning frame 27). The screws 91*a*, 91*b*, 92*a*, 92*b* which fix the bearing 29*a* and the bearing 29*b* to the unit 26 are removed. And, the bearing 29*a* and the bearing 29*b* are demounted from the unit 26. By this, the photosensitive drum 1 can be received by the C-shaped hole 27*b* of the cleaning frame 27, and therefore, the photosensitive drum 1 can be easily demounted from the drum unit 26. By demounting the photosensitive drum 1, while supporting the sliding portions (the one-end drum shaft 1*a* and the other end drum shaft 1*b*) received in the C-shaped hole 27*b* of a frame 27, the photosensitive layer of the photosensitive drum 1 is not touched directly by the operator. For this reason, the contamination attributable to contacting to the photosensitive drum 1 can be prevented.

When the photosensitive drum 1 is demounted from the drum unit 26, an elongated residual toner collection opening 49 is exposed, between the cleaning member 6 mounted to the unit 26 and a residual toner leakage preventing sheet 48. By this, a removal of a residual toner stored in the unit 26 becomes implementable using the residual toner collection opening 49. The cleaning is carried out by the air suction, the blowing, the wet type cleaning, wiping, or the like.

The disassembly of the charging roller 2 is carried out by demounting it from the charging roller bearings 28 which support the opposite ends. At this time, the charging roller 2 is demounted from the drum unit 26, while holding the charger spacer 41 (41*a*, 41*b*) rotatably mounted to the opposite ends of the charging roller 2. By this, the charging roller 2 is not directly touched by the operator. Therefore, the contamination attributable to contacting to the charging roller 2 can be prevented. The residual toner is removed after the charging roller 2 is demounted, and the contamination of the charging roller 2 and the damage of the charging roller 2 at the time of a cleaning can be prevented.

At the time of demounting the cleaning member 6 from the unit 26, the screws 93*a*, 93*b* which fix the cleaning member 6 to the unit 26 are removed.

The residual toner is removed after demounting the cleaning member 6. By this, the contamination of the cleaning member 6 and the damage at the time of the cleaning can be prevented. Furthermore, since the opening 49 enlarges, a cleaning efficiency is improved. If necessary, the cleaning of the charging roller 2 and the cleaning member 6 may be carried out.

Through steps in the order opposite to that of steps in the case of the above described disassembling, the re-assembling of the unit 26 is carried out. In other words, the cleaning member 6, the charging roller 2, and the photosensitive drum 1 are mounted in this order. Here, at least the photosensitive drum 1 is exchanged with a fresh photosensitive drum 1, and it is placed temporarily in the C-shaped hole 27*b* of the cleaning frame 27. And, the one-end drum bearing 29*a* and the other end drum bearing 29*b* are mounted to the cleaning frame 27, so that the re-assembling of the drum unit 26 is completed.

<iii> Disassembling, the Cleaning, the Parts Replacement, the Re-Assembling of the Developing Unit Referring to FIGS. 26-37, the description will be made as to the disassembling, the cleaning, the parts replacement, and the re-assembling of the developing unit 4 after separating the developing unit 4.

Figure 26:
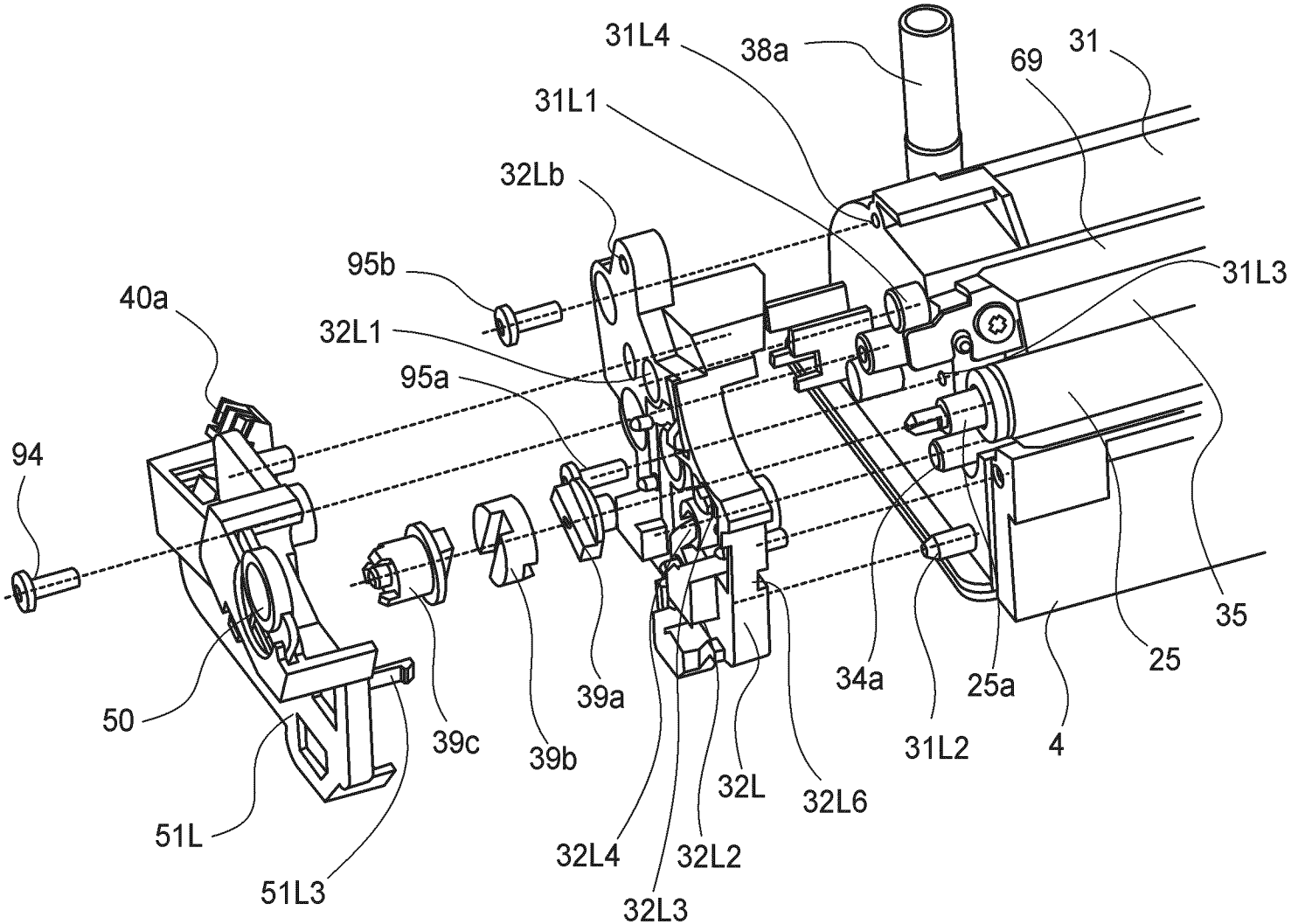
FIG. 26 is an exploded perspective view of the end of a developing unit of the process cartridge according to the embodiment of the present invention.

Referring to FIG. 26, the disassembling in the one-end portion of the unit 4 will be described. First, the screw 94 mounted to the one-end portion of the unit 4 is removed. By this, the side cover 51L at the one-end portion becomes dismountable together with the bearing member 50 of the coupling 39 and the spacer member 40*a*. And, a side cover 51L is demounted. By this, the engaging portion 39*a*, the engaging portion 39*b*, and the engaging portion 39*c* of the coupling 39 mounted to an end surface of the one-end shaft 25*a* of the developing roller 25 can be demounted easily. Then, the screws 95*a*, 95*b* mounted to the one-end portion of the unit 4 are removed. By this, the one end bearing member 32L becomes dismountable from the developing device frame 31. By the above-described step, the disassembling in the one-end portion of the developing unit 4 is completed.

Figure 27:
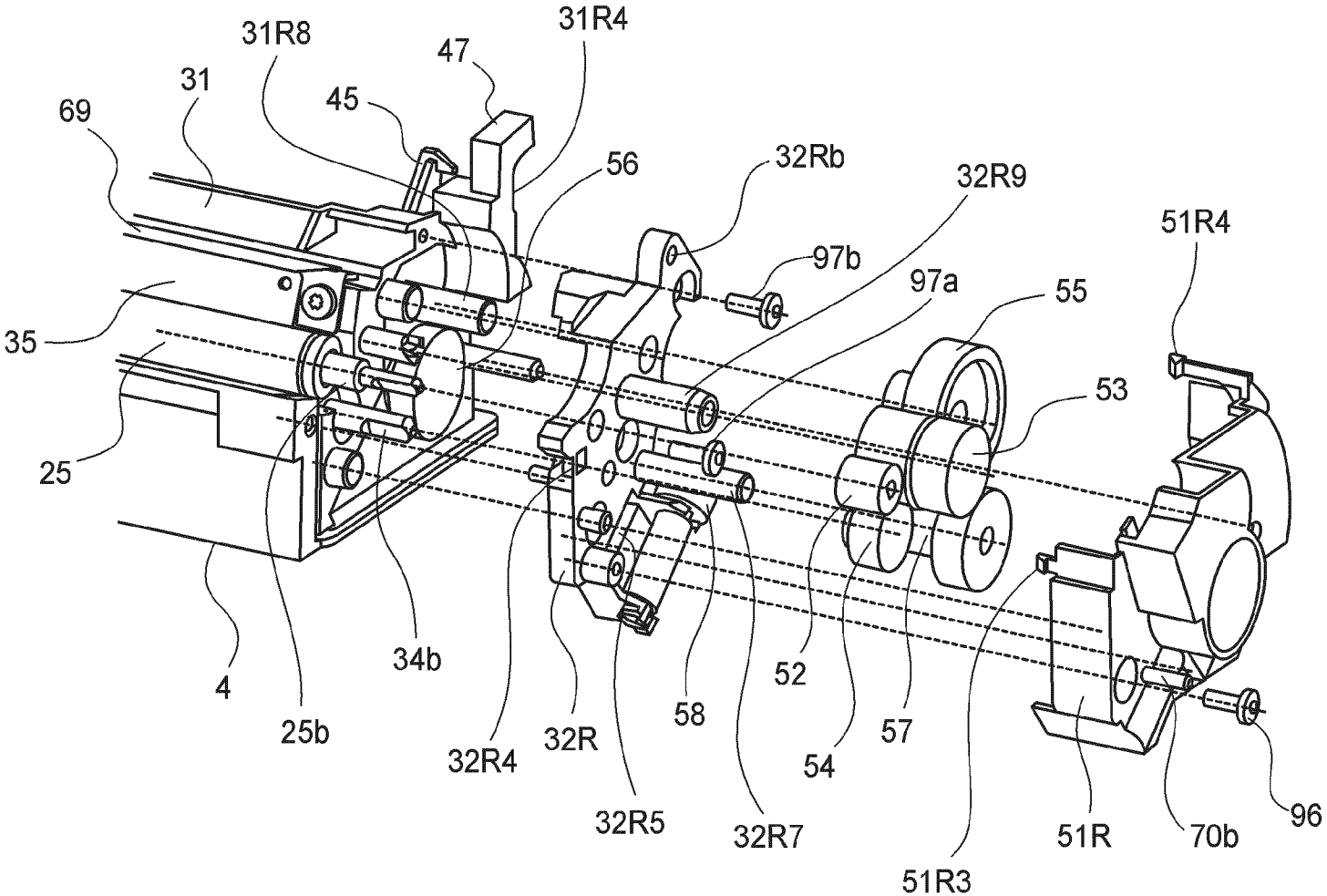
FIG. 27 is an exploded perspective view of the other end of the developing unit of the process cartridge according to the embodiment of the present invention.
Figure 28:
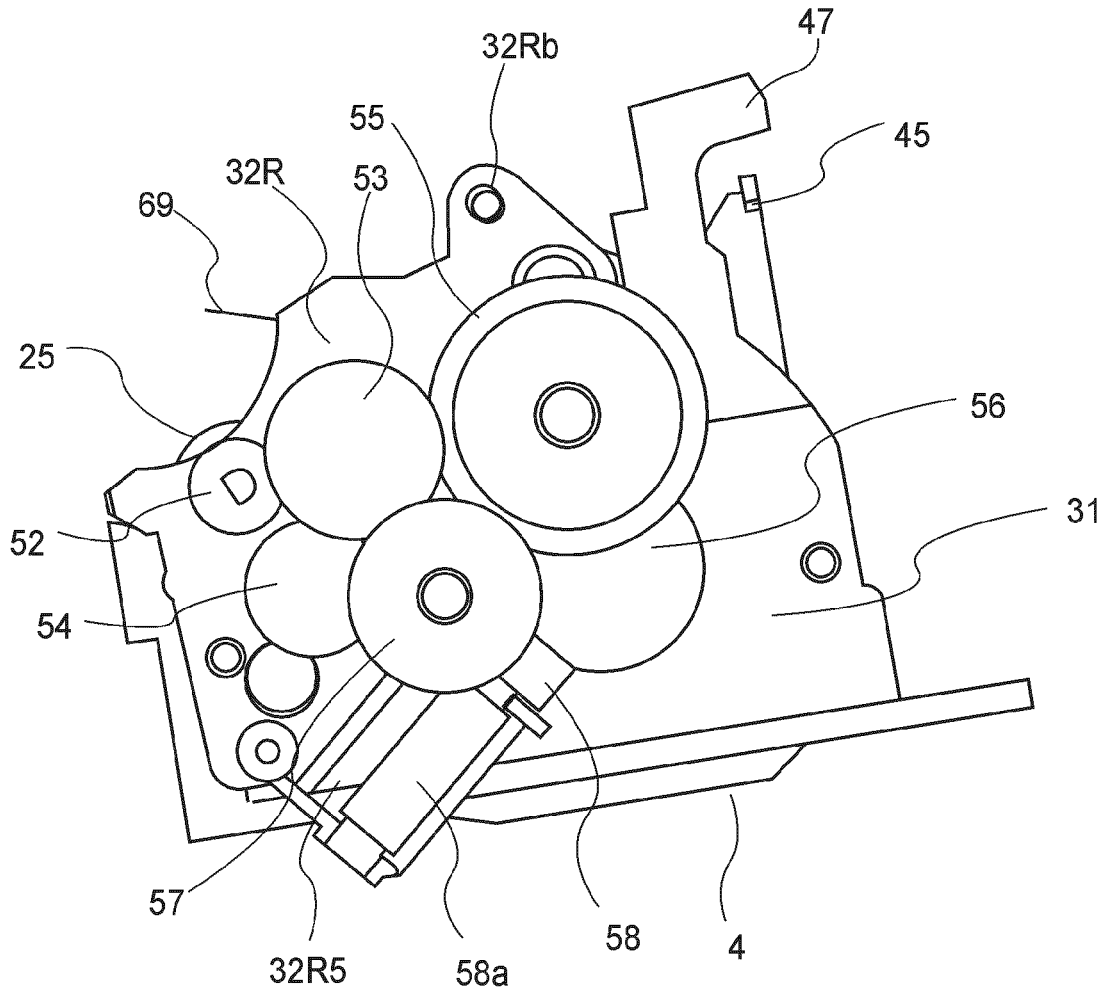
FIG. 28 is a side view of the other end of the developing unit of the process cartridge according to the embodiment of the present invention.

Referring to FIG. 27 and FIG. 28, the disassembling of the other end portion of the unit 4 will be described. First, the screw 96 mounted to the other end portion of the unit 4 is removed. By this, the other end side cover 51R becomes dismountable.

When the side cover 51R is demounted, gears 52-57 disposed at the other end portion of the unit 4 are exposed. A gear 52 is a developing roller gear and is fixed to the developing roller 25. The gear 53 is a development stirring gear for receiving the rotational force from the developing roller gear 52. The gear 53 rotates a development stirring member 61 which is disposed inside of the developing device frame 31 and which stirs the toner inside a developing device frame. Therefore, the gear 53 is fixed to the stirring member 61. The gear 54 is a toner supplying roller gear and is fixed to the toner supplying roller 34. The gear 54 rotates a supplying roller 34. Therefore, the gear 54 receives the rotational force from the gear 53. The gear 55 is a toner feeding idler gear. The gear 55 transmits the rotational force to a toner feeding gear 56 for rotating the toner feeding member 36 disposed in the toner accommodating portion 31*a*. Therefore, the gear 55 receives the rotational force from the gear 53. The gear 57 is a warm gear. The gear 57 transmits the rotational force to the toner seal rolling up gear 58 for rotating a toner seal winding-up shaft 58*a* for winding-up the toner seal 64 for sealing the toner accommodating portion 31*a*. Therefore, it receives the rotational force from the gear 53. The toner supplying roller 34 has a function of supplying the toner to the developing roller 25.

By demounting the other end side cover 51R, the gear 52, the gear 53, the gear 54, the gear 55, and the gear 57 are exposed. First, the gear 57 is pulled out of the shaft in the above described disassembling step of the gear train. By this, the gear 53 becomes dismountable. When the gear 53 is demounted, the other gears are exposed. Sequentially, the gear 52, the gear 54, and the gear 55 are pulled out from the respective shafts. After the usage of the cartridge 7, the toner seal 64 (FIG. 36) has been wound up on the toner seal winding-up shaft 58*a* constituted integrally with the gear 58. The gear 58 is demounted from the bearing member 32R, and the toner seal 64 wound up is demounted from the shaft 58*a*.

Then, the screws 97*a*, 97*b* mounted to the other end portion of the unit 4 are removed. By this, the bearing member 32R becomes dismountable from the developing device frame 31.

Figure 29:
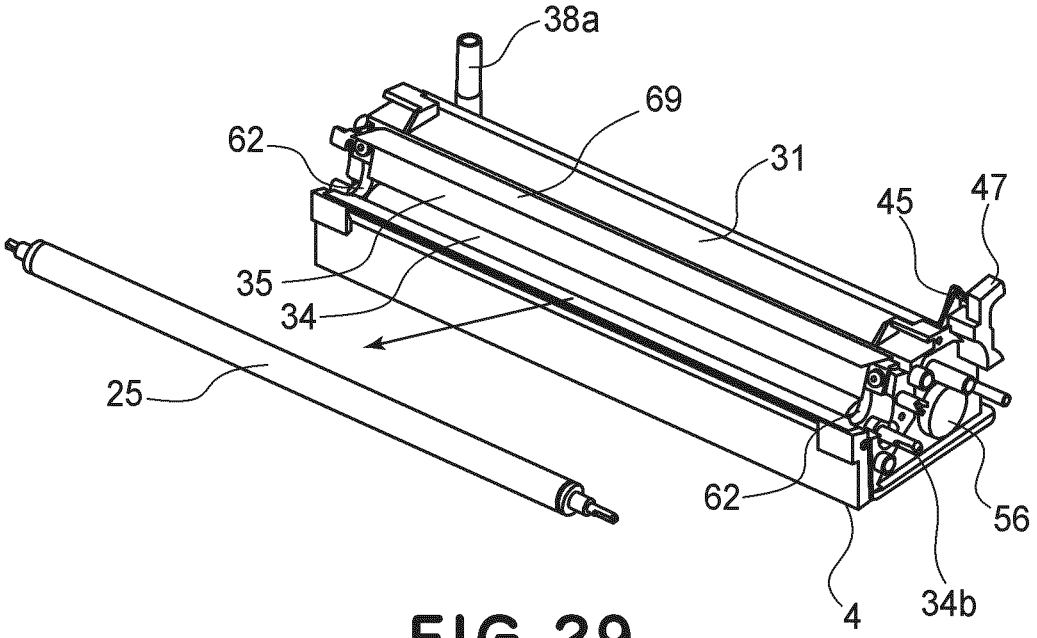
FIG. 29 is an exploded perspective view of the developing unit of the process cartridge according to the embodiment of the present invention.

By the above-described step, the disassembling of the other end portion of the unit 4 is completed. By this, the member which supports the developing roller 25 is demounted, and therefore, the developing roller 25 can be demounted easily (FIG. 29).

Figure 30:
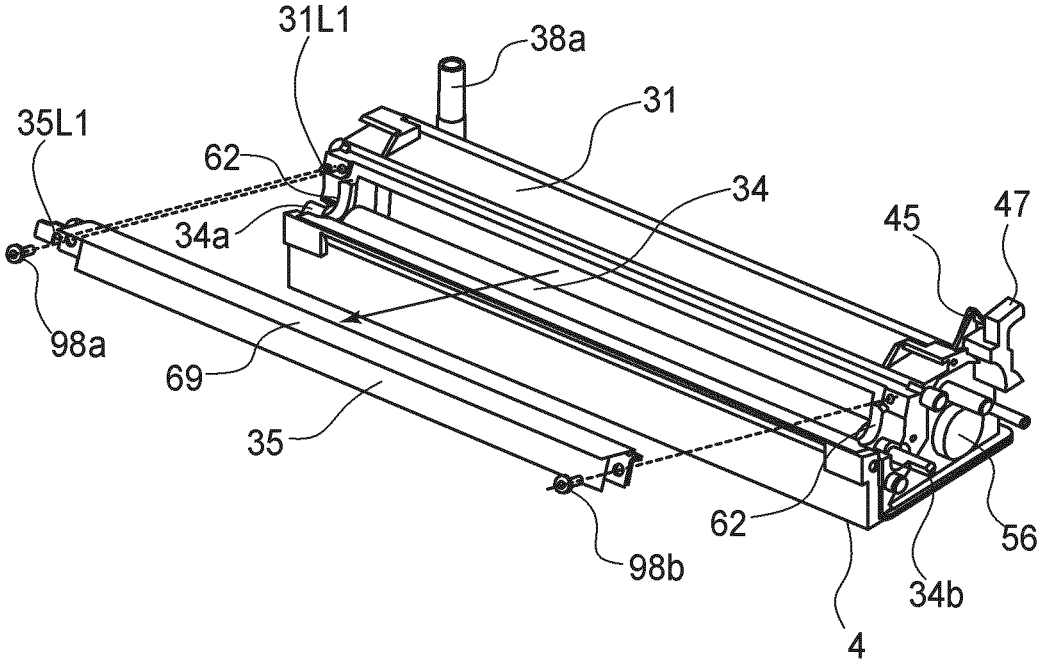
FIG. 30 is an exploded perspective view of the developing unit of the process cartridge according to the embodiment of the present invention.

Referring to FIG. 30, the description will be made as to a dismounting step for the developing blade 35. The developing blade 35 is fixed by the screws 98*a*, 98*b* to the developing device frame 31 in the opposite ends thereof. Therefore, the screws 98*a*, 98*b* are removed, and the developing blade 35 is raised, so that it becomes dismountable. At this time, a contact sheet 69 which is in contact to the photosensitive drum is demounted integrally with the developing blade 35.

Figure 31:
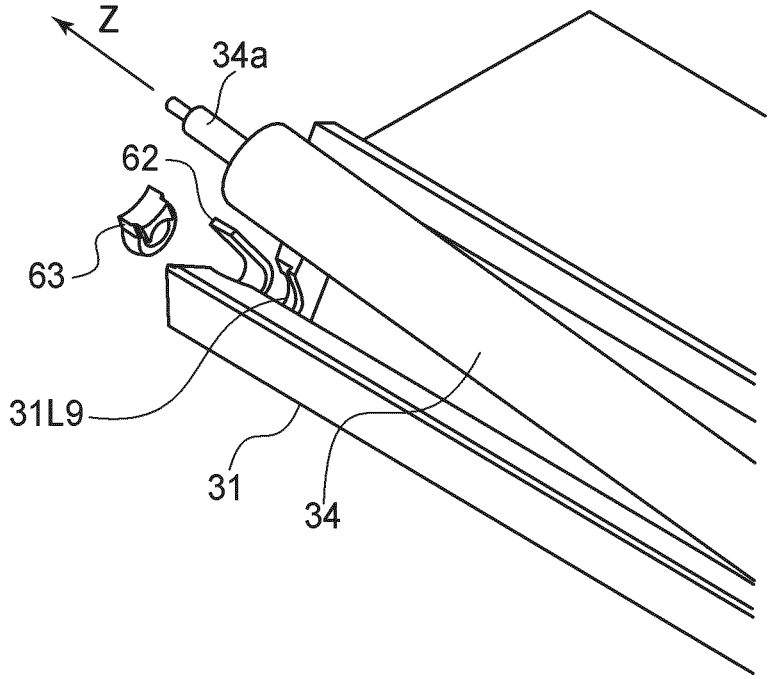
FIG. 31 is an exploded perspective view of the end of the developing unit of the process cartridge according to the embodiment of the present invention.

Referring to FIG. 31, the description will be made as to the dismounting step for the toner supplying roller 34. The end seal 62 is pasted, with a double coated tape, to the opposite ends of the developing device frame 31, in order to prevent the toner leakage from the opposite ends of the developing roller 25.

Here, as shown in FIG. 31, an end seal 62 of the one-end portion is peeled off partially, and is turned over. And, a bush 63 is pulled out toward the one-end portion, and it is demounted from the developing device frame 31. The bush 63 forms a seat for the end seal 62, and it engages loosely with the one-end shaft 34*a* of a roller 34, and engages with a bush mounting groove 31L9 of the developing device frame 31. The bush 63 is made of an elastic material, such as the rubber, and is press-fitted in the developing device frame 31 with the elastic deformation thereof.

Figure 32:
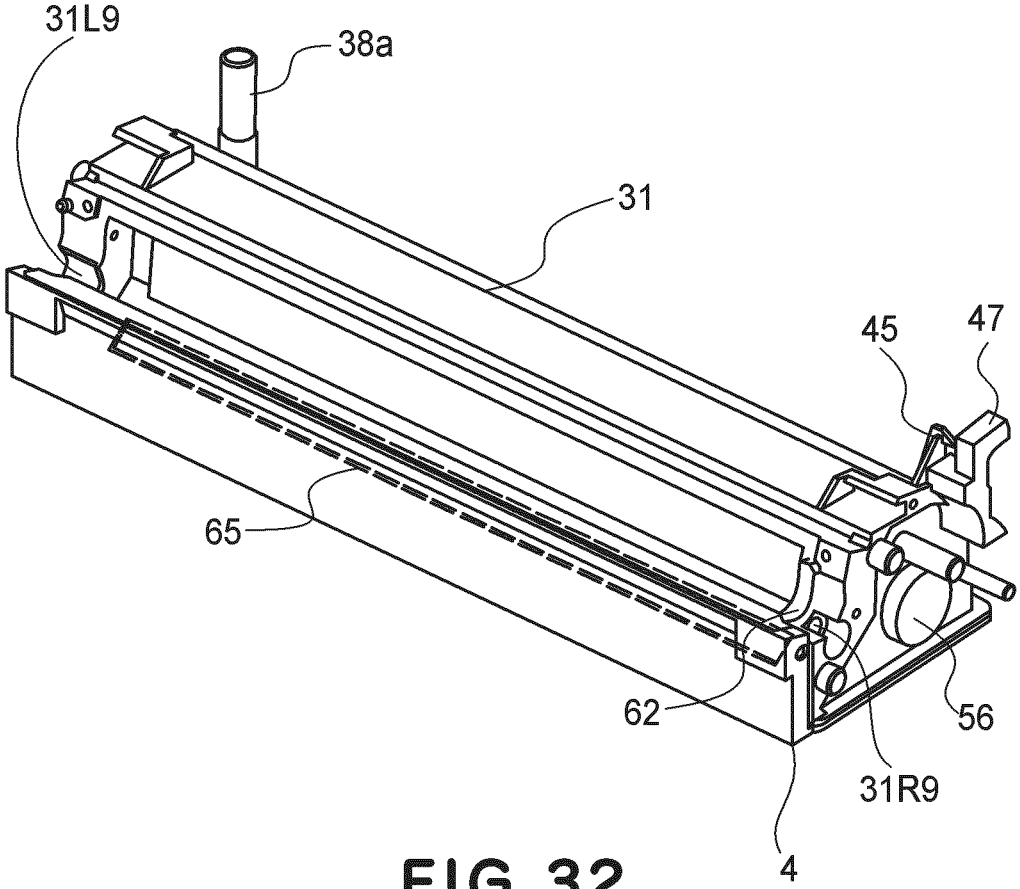
FIG. 32 is an exploded perspective view of the developing unit of the process cartridge according to the embodiment of the present invention.

As has been described hereinbefore, the bush 63 is demounted from the developing device frame 31. By this, it becomes possible to raise the one-end portion of the roller 34. As shown in FIG. 31, the roller 34 is obliquely lifted relative to the developing device frame 31, and is moved in the direction of the arrow Z in the Figure. By this, the roller 34 is pulled out of a through-hole 31R9 where the shaft 34*b* of the other end portion thereof is in engagement loosely. Then, the roller 34 can be demounted from the unit 4 (FIG. 32).

In the toner supplying roller dismounting step, the end seal 62 is peeled off partially and is turned over. However, the end seal 62 may be peeled off completely. And, thereafter, the end seal 62 peeled off may be again pasted at the time of the re-assembly. Or, the end seal 62 removed from another unit may be used, and a new end seal 62 may be used further.

Figure 33:
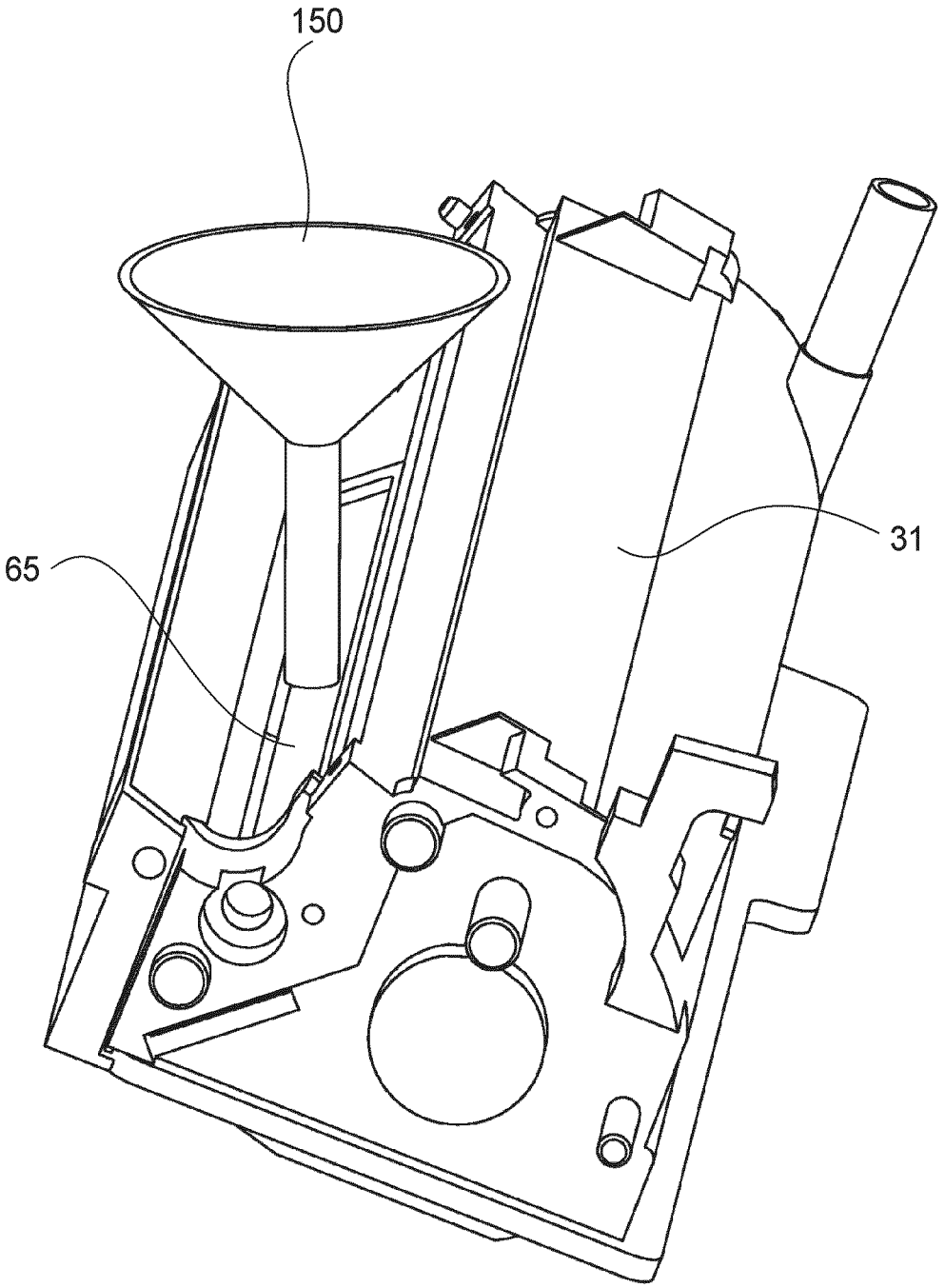
FIG. 33 is a schematic perspective view illustrating a toner refilling step for the process cartridge according to the embodiment of the present invention.

Next, the toner refilling step will be described. In this step, the toner is filled into the toner accommodating portion 31*a* through the toner supply opening (developer supply opening) 65 exposed by the above described disassembling step. As shown in FIG. 33, in a toner filling step, the opening 65 is turned up, the unit 4 is retained so that the toner accommodating portion 31*a* takes a lower position. And, a free end of a funnel 150 is inserted into the opening 65, and the toner is supplied from toner bottle (unshown) or the like into the funnel 150. By this, the toner to the toner accommodating portion 31*a* is refilled. A method for refilling the toner is not limited to the method using the funnel and the toner bottle, but a proper method is applicable.

As described above, as for the unit 4, the side covers 51R, 51L, the bearing members 32R, 32L, and the gears 52, 53, 54, 55, 57, 58 are removed sequentially after the separation between the unit 26 and the unit 4. In addition, the developing roller 25, the developing blade 35, and the roller 34 are demounted. By this, the opening 65 is opened. Therefore, the refilling of the toner t is easy.

And, after refilling the toner t into the toner accommodating portion 31*a* through the opening 65, the opening 65 is unsealably sealed with the toner seal 64 which has flexibility.

Figure 34:
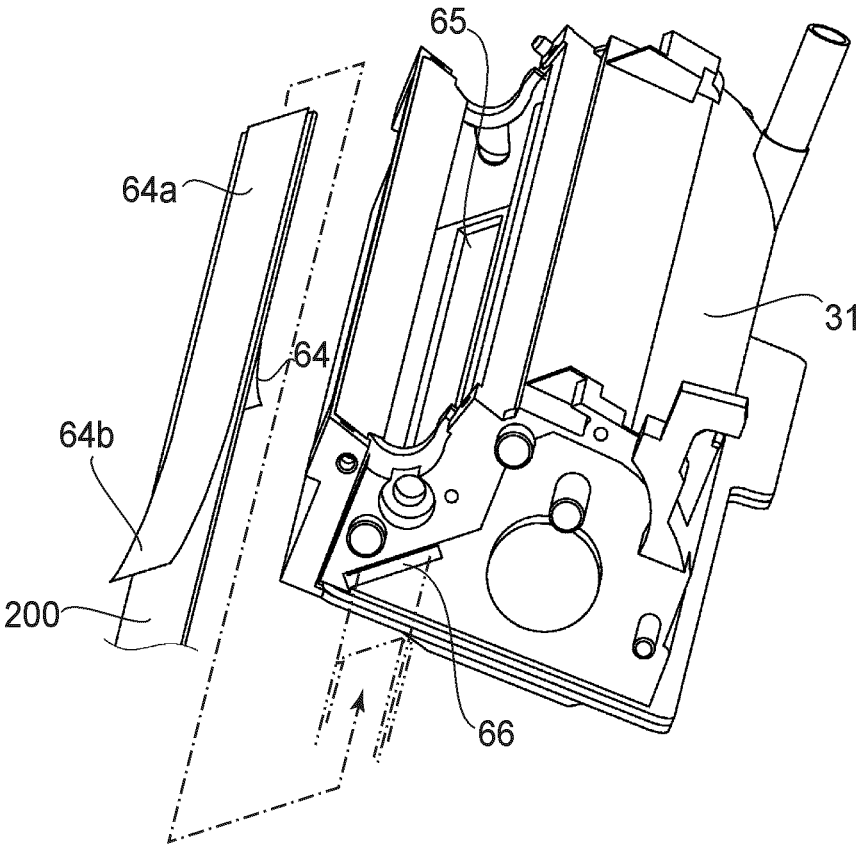
FIG. 34 is a schematic perspective view illustrating the sealing method for a toner seal for the process cartridge according to the embodiment of the present invention.

The sealing of the opening by this toner seal 64 is as shown in FIG. 34, for example. The new toner seal 64 is sufficiently inserted into the inside of the developing device frame 31 through the hole 66 for pulling out the toner seal by a heating jig 200 of a thin plate type. By this, a seal 64 covers the opening 65. Subsequently, a heat generating resistance layer provided in a jig 200 is energized. By this, the jig 200 is heated up to a predetermined temperature (150° C., for example). Then, a sealant layer laminated on the seal 64 welds to the circumference of the opening 65, so that the opening 65 is sealed. Thereafter, the jig 200 is pulled out. The opening 65 is sealed by the seal 64 in the state of FIG. 35. A free end portion 64*b* of the folded extension 64*a* of the seal 64 is exposed outwardly of the developing device frame 31 through the hole 66. A toner leakage preventing seal 67 provided in the hole 66 is exchanged with a new part, if necessary. In addition, the hole 66 permits the user to pull out the seal 64, prior to the mounting to the apparatus main assembly 100*a* of the new cartridge 7 or the cartridge 7 which is refilled with the toner. In the case of the cartridge 7 which is refilled with the toner, the seal 64 may be mounted or not.

Here, the method for pasting (resealing) of the seal 64 on the opening 65 is not be limited to the above methods, but connecting means of an adhesive material, double coated tape, or the like may be used.

Figure 35:
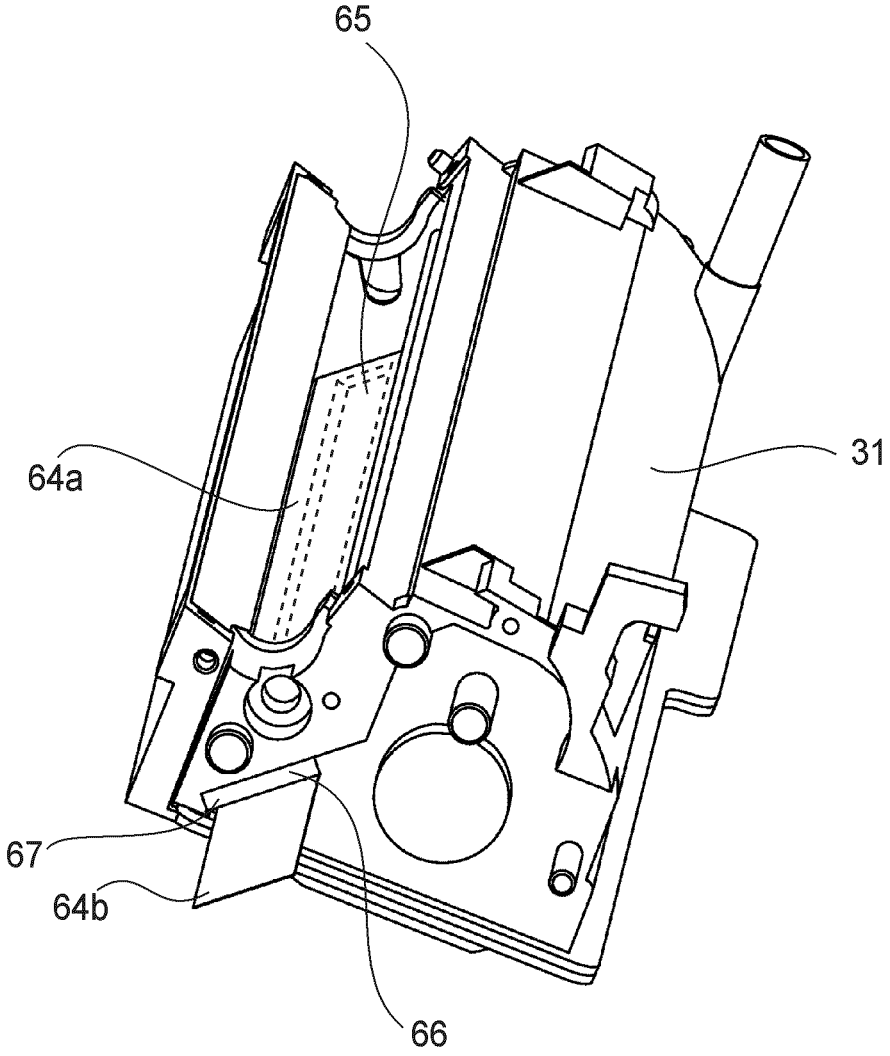
FIG. 35 is a schematic perspective view illustrating a toner seal mounting state for the process cartridge according to the embodiment of the present invention.

As mentioned above, if the seal 64 is restored, a remanufactured cartridge is the same as that of a new or fresh cartridge. In this embodiment, the seal 64 may not be mounted again, if the toner does not leak while carrying out the re-assembly of the developing unit. However, if the seal 64 is mounted as shown in FIG. 34 and FIG. 35 or by the other means, the leakage of the toner can be prevented assuredly.

After refilling the toner in the toner accommodating portion 31*a* as mentioned above, the developing unit 4 is assembled again. The re-assembling of the unit 4 is carried out through the process opposite from that of the disassembling step described above. More particularly, after the refilling of the toner, and the re-mounting of the toner seal, the roller 34, the developing blade 35, the developing roller 25, the bearing member 32L, and the side cover 51L are mounted to the developing device frame 31. In addition, the bearing members 32R, the gears 52, 53, 54, 55, and the side cover 51R are mounted.

The re-assembling method for the developing unit 4 will be described.

Referring to FIG. 31, the description will be made as to a toner supplying roller mounting operation. The roller 34 is moved in the direction opposite the direction of an arrow Z shown in FIG. 31, and the other end shaft 34*b* of the roller 34 is penetrated through the through-hole 31R9 (FIG. 32) of the developing device frame 31. The one-end shaft 34*a* of the roller 34 is engaged into the bush mounting groove 31L9 provided in the developing device frame 31. And, the bush 63 is press-fitted in the bush mounting groove 31L9 of the developing device frame 31 through the one-end shaft 34*a* of the roller 34 from the one-end portion of the developing device frame 31. The end seal 62 is pasted on an end-seal seat constituted by mounting the bush 63 to the developing device frame 31, at the one-end portion. By this, the mounting operation of the roller 34 is completed.

Referring to FIG. 30, a developing blade mounting operation will be described. The developing blade 35 is placed temporarily, while engaging a U-shaped groove 35L1 in the one-end portion with a developing blade positioning projection 31L1 of the developing device frame 31. Subsequently, while making a free end of the developing blade 35 align with the predetermined position, it is fixed by the screws 98*a*, 98*b* in the opposite ends. The sheet 69 for contacting to the photosensitive drum 1 is mounted, integrally with the developing blade 35, to the developing device frame 31. In addition, the sheet 69 may be exchanged with a new sheet, if necessary. Here, the mounting of the sheet to the developing blade 35 may be before the developing blade 35 is mounted to the developing device frame 31, or it may be after that.

Referring to FIGS. 26, 27, and 29, the description will be made as to a developing roller mounting operation and a bearing member mounting operation. The developing roller 25 is mounted to the predetermined position, by supporting the opposite ends by the bearing members 32.

First, the developing roller 25 is placed temporarily at the position on the developing device frame 31 so that it is in contact with the developing blade 35 and the roller 34.

Figure 36:
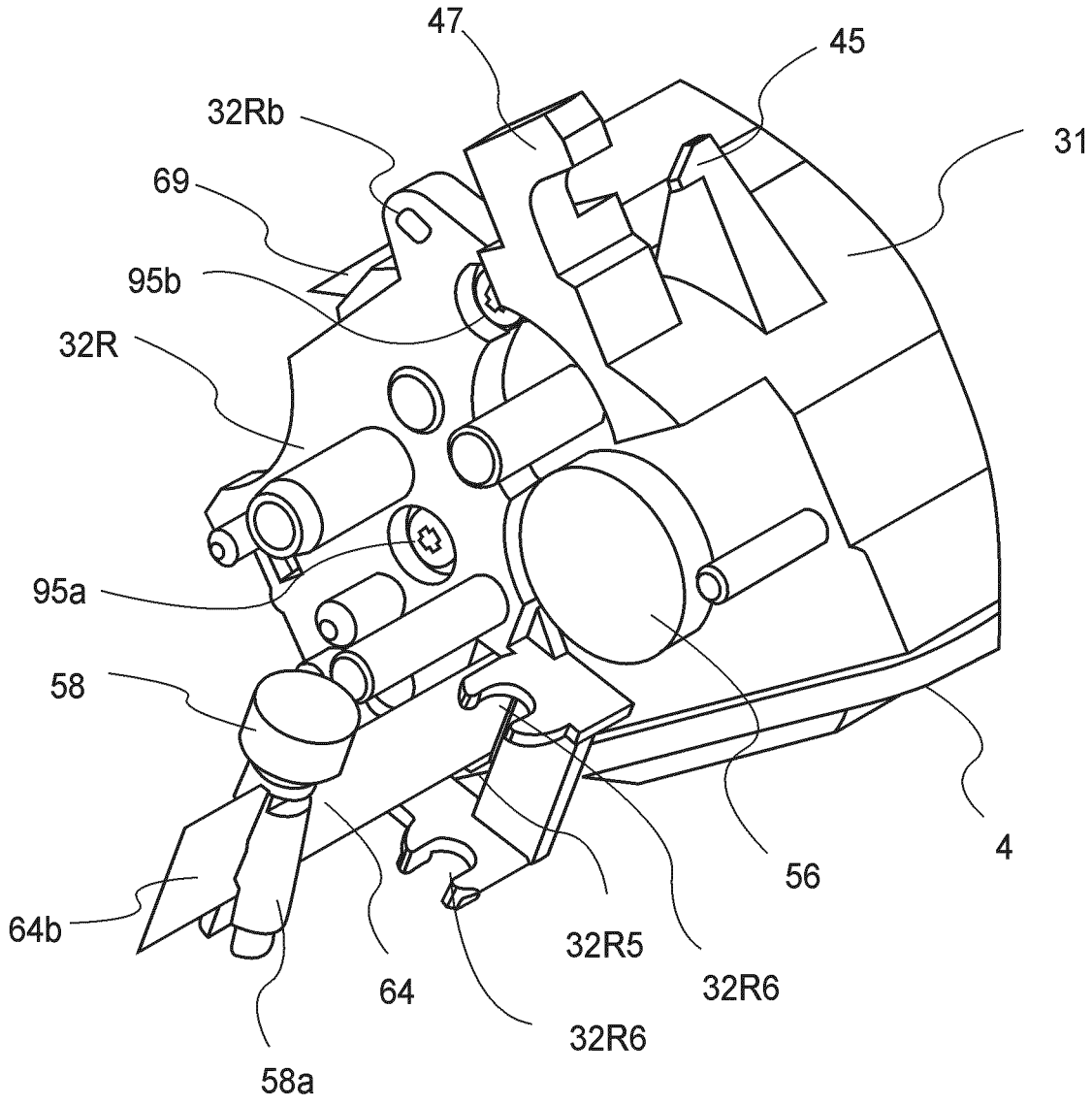
FIG. 36 is a schematic perspective view illustrating a toner seal winding-up method for the process cartridge according to the embodiment of the present invention.
Figure 37:
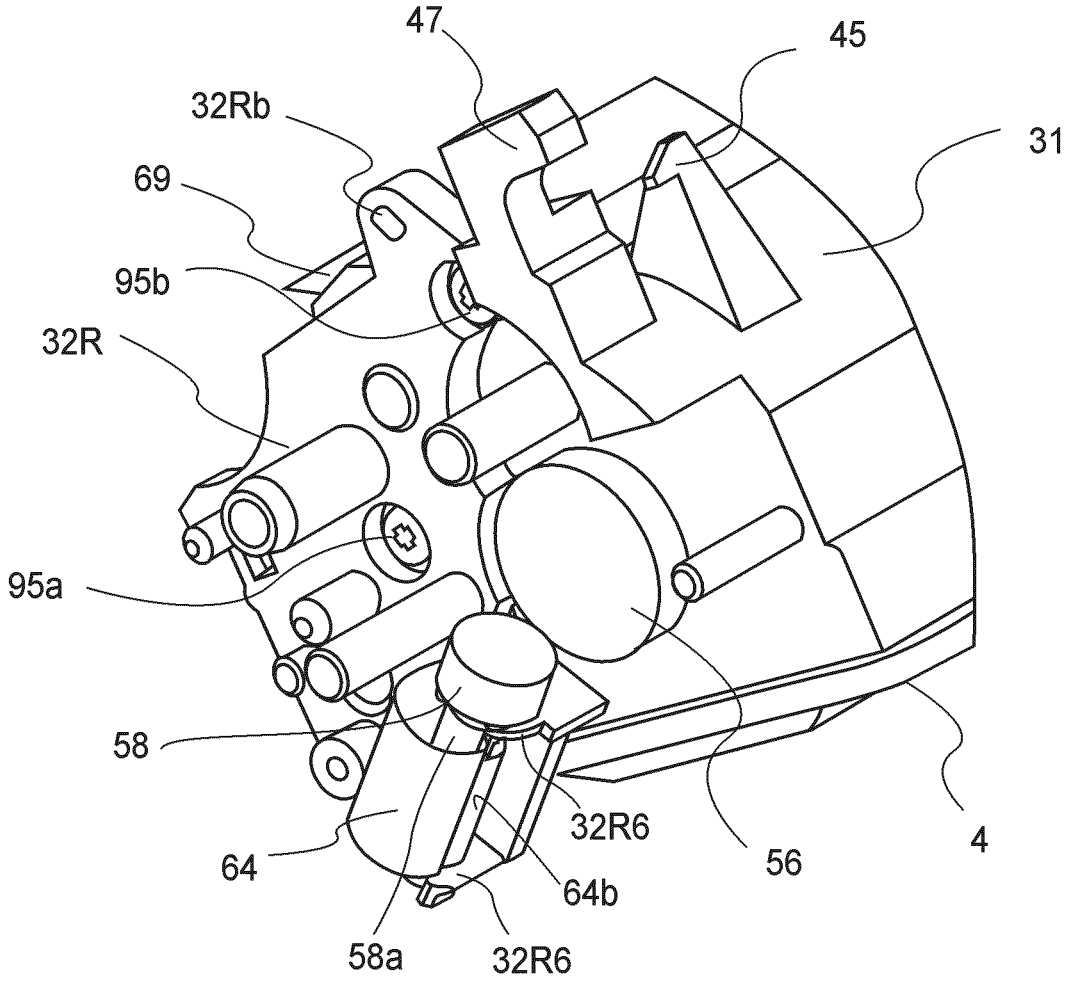
FIG. 37 is a schematic perspective view illustrating the toner seal winding-up method for the process cartridge according to the embodiment of the present invention.
Figure 38:
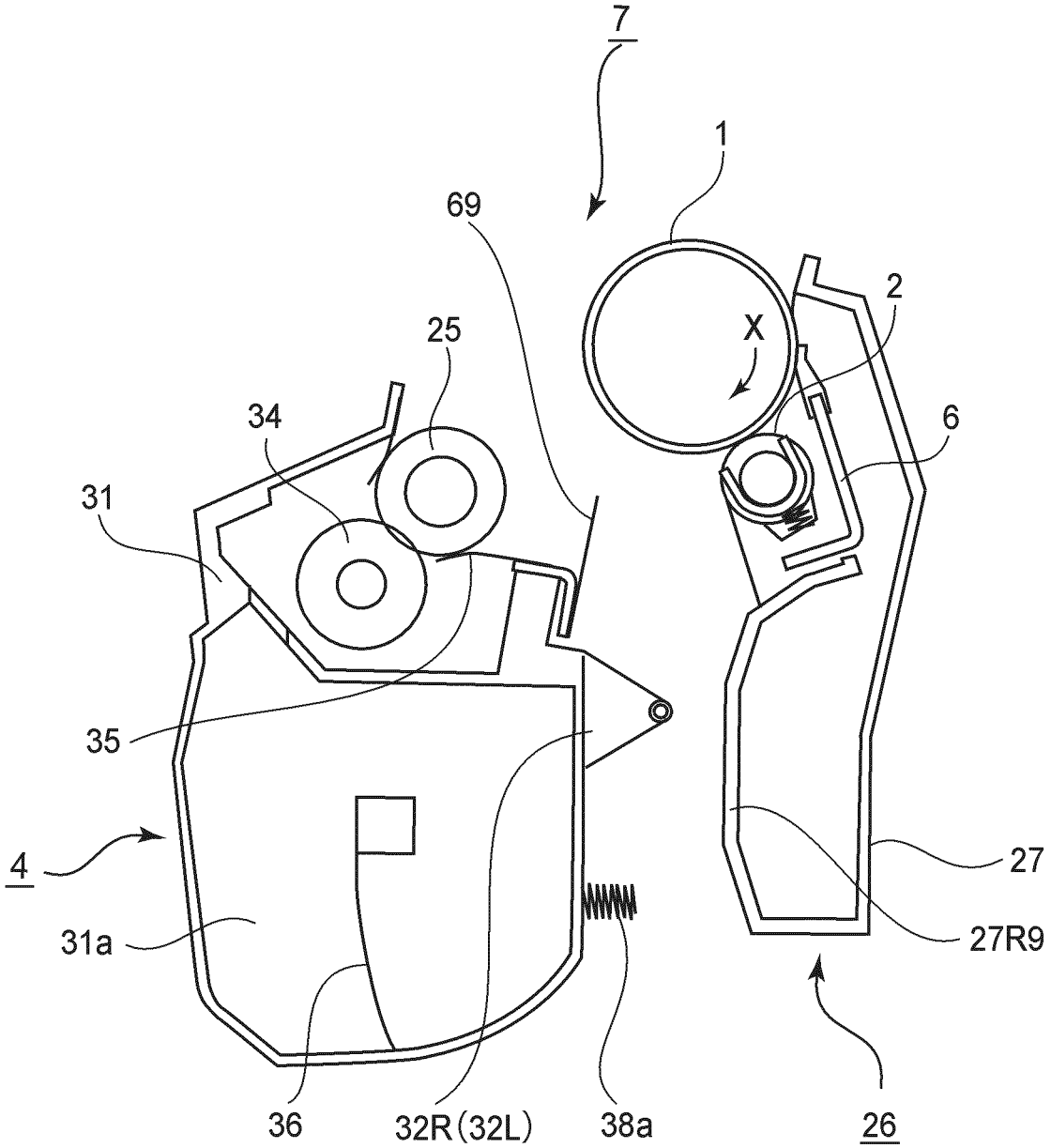
FIG. 38 is a sectional view illustrating a unit coupling of the process cartridge according to the embodiment of the present invention.

Subsequently, the bearing member 32L is mounted. The one-end portion of the developing device frame 31 is provided with end positioning engaging projections 31L1, 31L2 and screw holes 31L3, 31L4. In addition, the one-end bearing member 32L is provided with positioning holes 32L1, 32L2 for engaging with positioning engaging projection holes 31L1, 31L2, the engaging holes 32L3, 32L4 for rotatably supporting the one-end shafts 25*a*, 34*a* of the developing roller 25 and the roller 34. At first, the one-end bearing member 32L is moved, so that the one-end shafts 25*a*, 34*a* of the developing roller 25 and the roller 34 may penetrate the engaging holes 32L3, 32L4. Then, the positioning holes 32L1, 32L2 of the bearing member 32L are engaged with the end positioning engaging projections 31L1, 31L2 of the developing device frame 31. By this, the bearing member 32L is positioned in the developing device frame 31, and the bearing member 32L is mounted by the screws 95*a*, 95*b* to the developing device frame 31. Similarly, the other end bearing member 32R is mounted. By this, the developing roller 25 is positioned at a predetermined position of the unit 4, and the developing roller 25 is mounted. In addition, the toner seal 64 is exposed at the other end portion of the unit 4. The bearing member 32R is provided with a toner seal hole 32R5. At the time of mounting the bearing member 32R, the toner seal 64 penetrates the toner seal hole 32R5, and is exposed to the outside. And, the free end section 64*b* of the toner seal is mounted to the toner seal winding-up shaft 58*a*, and a predetermined amount is wound up on the shaft 58*a*. Then, the shaft 58*a* is rotatably mounted to a winding-up shaft engaging portion 32R6 of the bearing member 32R (FIG. 36 and FIG. 37). In this embodiment, the toner seal 64 is mounted to the shaft 58*a* by nipping, but this method is not restrictive, and the connecting means of the adhesive material, the double coated tape and so on may be used.

Then, a gear mounting operation will be described. The developing roller gear 52 is engaged with the other end shaft (the other end roller shaft) 25*b* of the developing roller 25. The gear 54 is engaged with the other end shaft 34*b* of the roller 34. The gear 55 is rotatably supported on a toner feeding idler gear shaft 31R8 provided on a side of the other end portion of the developing device frame 31. The development stirring gear 53 is rotatably supported on a development stirring gear shaft 32R9 of the bearing member 32R. so as to engage with the gear 52, the gear 54, and the gear 55. The warm gear 57 is mounted to a warm gear shaft 32R7, and it engages with the gear 53 and the gear 58 (FIG. 27 and FIG. 28).

Then, the other end side cover mounting operation will be described. The side cover 51R is positioned by an unshown positioning portion, and is pushed into the other end portion of the developing device frame 31. The side cover 51R is provided with snap fits 51R3, 51R4 for engaging with the bearing member 32R and the developing device frame 31. By pushing the side cover 51R, the snap fits 51R3, 51R4 engage with the engaging portion 32R4 of the bearing member 32R, and the engaging portion 31R4 of the developing device frame 31, respectively. In the state in which the side cover 51R is positioned as described above, it is fixed to the bearing member 32R using the screw 96 (FIG. 27).

One end side cover mounting operation will be described. This step is a step for supporting the Oldham coupling 39 which is the development drive input portion. First, the engaging portion 39*a* of the coupling 39 is fixed to the one-end shaft 25*a* of the developing roller 25. By combining the respective recesses and projections, the engaging portion 39*a*, the engaging portion 39*b*, and the engaging portion 39*c* are engaged. The engaging portion bearing member 50 is mounted to the side cover 51L and the bearing member 50 is urged in a predetermined direction by the spring 39*d* (FIG. 9 and FIG. 10). The side cover 51L is engaged while aligning the hole 50*a* of the bearing member 50 with a shaft portion 39*c*1 of the engaging portion 39*c*. It is assembled by positioning using the positioning portion (unshown) of the side cover 51L. In addition, the side cover 51L is provided with the snap fit 51L3 for engaging with the bearing member 32L. By pushing in the side cover 51L, the snap fit 51L3 engages with the engaging portion 32L6 of the bearing member 32L. As mentioned above, in the state in which the side cover 51L is positioned, it is fixed to the developing device frame 31 using the screw 94 (FIG. 26).

By the above step, the re-assembling step of the developing unit 4 is completed.

<iv> Unit Coupling

As mentioned above, the reassembled unit 26 and the unit 4 are connected swingably with each other, and they are completed into a cartridge. Referring to FIG. 1, FIGS. 3, 5-7, 9-19, and 38, the unit coupling will be described.

The unit 4 is swingably connected to the unit 26. To do this, the holes 32Rb, 32Lb of the bearing member 32 of the unit 4 are aligned with the holes 26Rb, 26Lb of the unit 26. At this time, the sheet 69 pasted on a blade 35 of the unit 4 is contacted (FIG. 3), so that it bends codirectionally with the rotational direction (arrow X of FIG. 39) of the photosensitive drum 1. The engaging portion bearing member (bearing engaging member) 50 which rotatably supports the engaging portion 39*c* of the coupling 39 of the development drive input portion is contacted to the two surfaces of the V-shaped recess 29*a*1 provided in the one-end drum bearing 29*a* (FIG. 9 and FIG. 10). Furthermore, the compression urging spring 38*a* is pressed to a pressing spring receiving surface 27R9 (FIG. 3 and FIG. 38) of the cleaning frame 27. The releasing claw 45 provided at the other end portion of the unit 4 is engaged with the opening 44 of the charger spacer 41*b* (FIG. 19). In the state in which these parts are aligned, the shaft 37 is inserted into the holes 26Rb, 26Lb of the unit 26 through the holes 32Rb, 32Lb of the bearing member 32.

Then, the tension spring 38*b* is stretched between the unit 4 and spring stretching bosses 70*a*, 70*b* of the unit 26 (FIG. 6).

Then, for prevention of the permanent deformations of the developing roller 25 and the charging roller 2, the developing roller spacing and the charging roller spacing are carried out. Here, the developing roller spacing is to separate the developing roller 25 from the photosensitive drum 1. The charging roller spacing is to separate the charging roller 2 from the photosensitive drum 1.

A developing device spacing member is inserted into between the units 4, 26 in a developing roller spacing step, so that the photosensitive drum 1 and the developing roller 25 space from each other. The developing device spacing at the one-end portion rotates the spacer member 40*a* rotatably supported on the one-end portion of the developing unit 4 (FIGS. 11 and 12). And, it engages the engaging surface 40*a*1 with the opening 42 provided at the one-end portion of the unit 26. At the one-end portion of the unit 4, the rotation is limited, so that the unit 4 is retained in the state in which the developing roller 25 spaces from the photosensitive drum 1 against the urging force of the compression urging spring 38*a*. In the developing device spacing in the other end portion, the spacer member 40*b* rotatably supported on the other end portion of the unit 26 is rotated. And, the engaging portion 40*b*1 is engaged with the developing device spacing projection 47 inside the cleaning frame 27 at the other end portion of the developing unit 4 (FIG. 13-FIG. 16). By this, at the other end portion of the developing unit 4, the rotation is regulated so that the developing unit 4 is retained in the state in which the developing roller 25 spaces from the photosensitive drum 1 against the urging force of the compression urging spring 38*b*.

As has been described hereinbefore, the spacer member 40*a* is engaged with the opening 42. The spacer member 40*b* is engaged with a projection 47. Here, the spacer member 40*a* is rotatable about the axis of the shaft 40*a*3 at the one-end portion of the unit 4. In addition, the spacer member 40*b* is rotatable about the axis of the shaft 27L8 at the other end portion of the unit 26. According to this embodiment, since the spacer member 40*a* and the spacer member 40*b* are mounted to the unit, the assembly operativity is improved, as compared with the case where the spacer member is unintegral with the unit. This is because the spacer member can be moved integrally with the unit at the time of the assembling. Additionally, by rotating the spacer members 40*a*, 40*b* about the axes of the shaft 40*a*3 and the shaft 27L8, they can be engaged with the opening 42 and the projection 47, in the case of the developing device spacing according to this embodiment. This operation is manually carried out by an operator, or is carried out using an automatic machine. In either case, the operativity in the assembling and the remanufacturing can be improved. According to this embodiment, at the time of releasing the developing device spacing, the spacer members 40*a*, 40*b* may be rotated about the axes of the shaft 40*a*3 and the shaft 27L8 away from the opening 42 and the projection 47. Also in this case, the operativity of the disassembling and the remanufacturing can be improved. When the cartridge 7 is mounted to the apparatus main assembly 100*a*, the developing device spacing is carried out by the member provided in the apparatus main assembly 100*a*, as has been described hereinbefore.

The photosensitive drum 1 and the charging roller 2 are spaced from each other in a charging roller spacing step by the spacer member 41. The charger spacing is carried out at the one-end portion (FIG. 17, FIG. 20) by engaging the charger spacer 41*a* rotatably supported on the one-end portion of the charging roller 2 with the charger spacing pawl 43*a* provided at the one-end portion of the unit 26. It is carried out also in the other end portion (FIG. 18, FIG. 21), by engaging the spacer member 41*b* with the charger spacing pawl 43*b* similarly.

Through the step as described above, the developing device spacing is carried out easily. Therefore, according to this embodiment, the simple assembling method, the disassembling method, and the remanufacturing method for the cartridge by an ordinary tool without using the special jig are provided. However, a special jig and so on may be used, though.

The present embodiment provides a cartridge remanufacturing method for making usable the cartridge from which the developer has been consumed.

The present embodiment provides the cartridge remanufacturing method with which the simple refilling of the developer is possible.

The assembling method for the cartridge 7 of the embodiment described above is summarized as follows.

<1> It comprises a unit coupling step of connecting swingably the unit 26 for supporting the photosensitive drum 1 and the unit 4 with each other. The unit 4 supports the developing roller 25 for developing the electrostatic latent image formed on the photosensitive drum 1, the developer supplying roller 34 for supplying the developer to the developing roller, and the developer accommodating portion 31*a* which has the developer supply opening 65.

<2> It comprises a first developing device spacing member mounting operation, after connecting the unit 26 and the unit 4 with each other by the unit coupling step. By this, the first developing device spacing member 40*a* provided rotatably about the axis of the shaft 40*a*3 at the one-end portion of the unit 4 is engaged with the opening 42 provided at the one-end portion of the unit 26 to prevent the unit 4 from rotation relative to the unit 26.

<3> It comprises a second developing device spacing member mounting operation. By this, a second developing device spacing member 40*b* provided rotatably about the axis of the shaft 27L8 at the other end portion of the unit 26 is engaged with the projection 47 provided at the other end portion of the unit 4 to prevent the unit 4 from the rotation relative to the unit 26.

By this, as has been described hereinbefore, the simple assembling method for the process cartridge is provided.

Here, at the time of connecting the unit 26 and the unit 4 with each other by the unit coupling step, the bearing engaging member 50 of the coupling 39 is abutted to the recess 29*a*1 provided in the unit 26. The coupling 39 is swingably mounted to the unit 4, and receives the rotational force for rotating the developing roller 25. An engaging member 50 rotatably supports the coupling 39. In this manner, according to this embodiment, by abutting the engaging member 50 to the recess 29*a*1, the position of engaging member 50 (coupling 39) is determined. Accordingly, the assembling is easy. The recess 29*a*1 has the shape of V, and enhances the effects described above.

The disassembling method for the cartridge 7 of the embodiment is summarized as follows. The cartridge 7 comprises the unit 26 for supporting the photosensitive drum 1. In addition, the cartridge 7 has the developing unit 4 which supports the developing roller 25 for developing the electrostatic latent image formed on the photosensitive drum 1, the developer supplying roller 34 for supplying the developer to the developing roller, and the developer accommodating portion 31*a* which has the developer supply opening 65. The drum unit 26 and the developing unit 4 are connected swingably to each other. The disassembling method of this cartridge comprises the following steps.

(1) It comprises the spring dismounting step of demounting the tension spring 38*b* which has the one end mounted in the one end to the drum unit 26 and the other end mounted to the developing unit 4.

<2> It comprises the shaft demounting step of demounting the shaft 37L of the one-end portion and the shaft 37R of the other end portion which connect the unit 26 and the unit 4 swingably with each other.

<3> It comprises the first developing device spacing member releasing step. By this, the rotation of the unit 4 relative to the unit 26 is permitted. Then, the spacer member 40*a* provided rotatably about the axis of the shaft 40*a*3 at the one-end portion of the unit 4 is removed through the opening 42 provided at the one-end portion of the unit 26.

<4> It comprises the second developing device spacing member releasing step. By this, the rotation of the unit 4 relative to the unit 26 is permitted. In other words, the spacer member 40*b* provided rotatably about the axis of the shaft 27L8 at the other end portion of the unit 26 is removed from the projection 47 provided at the other end portion of the unit 4.

In this manner, as has been described hereinbefore, the disassembling method for the process cartridge with which disassembling is simple is provided.

The remanufacturing method for the cartridge 7 of the embodiment is summarized as follows.

The cartridge 7 includes the unit 26 which supports the photosensitive drum 1. In addition, the cartridge 7 includes the unit 4 for supporting the developing roller 25 for developing the electrostatic latent image formed on the photosensitive drum 1, the developer supplying roller 34 for supplying the developer to the developing roller, and the developer accommodating portion 31*a* that has the developer supply opening 65. The unit 26 and the unit 4 connect swingably to each other. This remanufacturing method for the process cartridge comprises the following steps.

<1> It comprises the spring dismounting step of demounting the tension spring 38*b* which has the one end mounted to the unit 26, and the other end mounted to the unit 4.

<2> It comprises the shaft demounting step of demounting the shaft 37L of the one-end portion and the shaft 37R of the other end portion which connect the unit 26 and the unit 4 swingably with each other.

<3> It comprises the first developing device spacing member releasing step described above.

<4> It comprises the second developing device spacing member releasing step described above.

<5> It comprises the unit separating step of separating the unit 26 and the unit 4 from each other.

<6> It comprises the drum dismounting step of demounting the photosensitive drum 1 from the unit 26.

<7> It comprises the developing roller dismounting step of demounting the developing roller 25 from the unit 4.

<8> It comprises the developing blade dismounting step of demounting the developing blade 35 for regulating the amount of the developer deposited on the peripheral surface of the developing roller 25 from the unit 4.

<9> It comprises the developer supplying roller dismounting step of demounting the developer supplying roller 34 from the unit 4.

<10> It comprises the developer refilling step of refilling the developer into the developer accommodating portion 31*a* from the exposed developer supply opening 65.

<11> It comprises the drum mounting operation of mounting the new photosensitive drum 1 to the unit 26.

<12> It comprises the developer supplying roller mounting operation of mounting the developer supplying roller 34 to the unit 4.

<13> It comprises the developing blade mounting operation of mounting the developing blade 35 to the unit 4.

<14> It comprises the developing roller mounting operation of mounting the developing roller 25 to the unit 4.

<15> It comprises the unit coupling step of connecting the unit 26 and the unit swingably using the shaft 37L at the one-end portion and the shaft 37R at the other end portion.

<16> It comprises the spring mounting step of mounting the tension spring 38*b* to the unit 26 at the one end, and mounting to the unit 4 at the other end to urge the developing roller 25 to the photosensitive drum 1.

<17> It comprises the first developing device spacing member mounting step described above.

<18> It comprises the second developing device spacing member mounting step described above.

By this, the state in which the developing roller 25 is separated from the photosensitive drum 1 can be maintained. As has been described hereinbefore, this operativity is improved.

In this manner, the simple remanufacturing method for the process cartridge is provided. In addition, the remanufacturing method for the process cartridge which can make usable the process cartridge from which the developer has been consumed is provided.

It comprises the developer removing step of removing the developer contained in the removed developer accommodating portion through the opening 49 of the removed developer accommodating portion 27*a*, after demounting the photosensitive drum 1, the charging roller 25, and the cleaning member 6 from the unit 26. The photosensitive drum 1 is taken out of the unit 26, by the drum dismounting step. The charging roller 25 is mounted to the unit 26 to charge the photosensitive drum 1. The cleaning member 6 is mounted to the unit 26 in order to remove the developer which remains on the photosensitive drum. The removed developer accommodating portion 27*a* contains the developer removed by the cleaning member 6 from the photosensitive drum 1.

By demounting the photosensitive drum 1, the charging roller 25, and the cleaning member 6 from the unit 26, an exposed portion of the residual toner collection opening 49 is enlarged. Therefore, the cleaning efficiency can be improved.

It comprises a toner seal mounting step after refilling the developer in the developer accommodating portion 31*a* by the developer refilling step. The toner seal 64 is mounted to the developer accommodating portion 31*a* in this step, and the end of the seal 64 is mounted to the toner seal winding-up shaft, so as to close the exposed developer supply opening 65. By mounting the seal 64, the leakage of the toner can be prevented.

At the time of connecting the unit 26 and the unit 4 with each other by the unit coupling step, while abutting the engaging member 50 of the coupling 39 to the recess 29*a*1 provided in the unit 26, the unit 26 and the unit 4 are connected with each other. The coupling 39 is swingably mounted to the unit 4. In this manner, according to this embodiment, in the case of the connection, the position of the coupling 39 is determined, and therefore, the assembling is easy.

The remanufacturing method for the cartridge 7 of the embodiment is summarized as follows.

The cartridge 7 includes the unit 26 for supporting the photosensitive drum 1. In addition, the cartridge 7 includes the unit 4 for supporting the developing roller 25 for developing the electrostatic latent image formed on the photosensitive drum 1, the developer supplying roller 34 for supplying the developer to the developing roller, and the developer accommodating portion 31*a* which has the developer supply opening 65. The unit 26 and the unit 4 are connected swingably with each other. The remanufacturing method for this cartridge comprises the following steps.

<1> It comprises the spring dismounting step of demounting the tension spring 38*b* which has one end mounted to the unit 26 and the other end mounted to the unit 4.

<2> It comprises the unit separating step of separating the unit 26 and the unit 4 from each other, by demounting the shaft 37L of the one-end portion and the shaft 37R of the other end portion which connect the unit 26 and the unit 4 with each other.

<3> It comprises the first developing device spacing member releasing step described above.

<4> It comprises the second developing device spacing member releasing step described above.

<5> It comprises the one-end drum bearing dismounting step of demounting the one-end drum bearing 29*a* from the unit 26, by demounting the screw 91 (91*a*, 91*b*).

<6> It comprises the other end drum bearing dismounting step of demounting the other end drum bearing 29*b* from the unit 26, by demounting the screw 92 (92*a*, 92*b*).

<7> It comprises the drum removal step of taking the photosensitive drum 1 out of the unit 26.

<8> It comprises the one-end bearing member dismounting step, in which the side cover 51L is demounted by demounting the screw 94, and subsequently, the coupling 39 for receiving the rotational force for rotating the developing roller 25 is demounted, and then subsequently, the one-end bearing member 32L is demounted.

<9> It comprises the other end bearing member dismounting step, in which the side cover 51R is demounted by demounting the screw 96, and subsequently, a plurality of gears 52-57 are demounted, and subsequently, the bearing member 32R is demounted.

<10> It comprises the developing roller dismounting step of demounting the developing roller 25 from the unit 4.

<11> It comprises the developing blade dismounting step of demounting the developing blade 35 for regulating a developer quantity deposited on the peripheral surface of the developing roller 25 from, the unit 4.

<12> It comprises the developer supplying roller dismounting step of demounting the developer supplying roller 34 from the unit 4.

<13> It comprises the developer refilling step of refilling the developer into the developer accommodating portion 31*a* through the exposed developer supply opening 65.

<14> It comprises the one-end drum bearing mounting step of mounting the bearing 29*a* to the unit 26 by the screw 91 (91*a*, 91*b*), in the state in which the one-end drum bearing 29*a* supports the one-end drum shaft 1*a* of the new photosensitive drum 1.

<15> It comprises the other end drum bearing mounting step of mounting the bearing 29*b* to the unit 26 by screw 92 (92*a* and 92*b*), in the state in which the other end drum bearing 29*b* supports the other end drum shaft 1*b* of the new photosensitive drum 1.

<16> The one-end bearing member 32L is mounted using screw 95 (95*a* and 95*b*) to the developing unit 4, in the state in which the one-end bearing member 32L supports the one-end roller shaft 25*a* of the developing roller 25. It comprises the developing roller one-end portion mounting step of mounting the coupling 39 and subsequently mounting the side cover 51L using the screw 94.

<17> The bearing member 32R is mounted to the unit 4 using the screw 97, in the state in which the other end bearing member 32R supports the other end roller shaft 25*b* of the developing roller 25. It comprises the other end portion developing roller mounting step of mounting a plurality of gears 52—mounting 57 and subsequently mounting, using the screw 96, the side cover 51R.

<18> It comprises the unit coupling step of connecting the unit 26 and the unit 4 swingably with each other using the shaft 37L of the one-end portion, and the shaft 37R of the other end portion.

<19> It comprises the spring mounting step of mounting the one end to the unit 26 and mounting the other end to the unit 4 to mount the tension spring 38*b* between the units.

<20> It comprises the step, described above, of mounting the first developing device spacing member.

<21> It comprises the second developing device spacing member mounting step described above.

It comprises the developer removing step of removing the developer contained in the removed developer accommodating portion through the opening 49 of the removed developer accommodating portion 27*a*, after the photosensitive drum 1, the charging roller 25, and the cleaning member 6 are demounted from the unit 4. The photosensitive drum 1 is taken out of the unit 26 by the drum dismounting step. The charging roller 25 is mounted to the unit 26. in order to carry out 1 charging of the photosensitive drum. The cleaning member 6 is mounted to the drum unit 26 in order to remove the developer which remains in the photosensitive drum 1. The removed developer accommodating portion 27*a* contains the developer removed by the cleaning member 6 from the photosensitive drum 1.

The photosensitive drum 1, the charging roller 25, and the cleaning member 6 are demounted from the unit 26. This enlarges the exposed portion of the residual toner collection opening 49. Therefore, the cleaning efficiency can be improved.

It comprises the step of mounting a toner seal by the developer refilling step, after refilling the developer in the developer accommodating portion 31*a*. In this step, the toner seal 64 is mounted to the developer accommodating portion 31*a*, and the end of the toner seal 64 is mounted to the toner seal winding-up shaft so as to close the exposed developer supply opening 65. By mounting the toner seal 64, the leakage of the toner can be prevented assuredly.

At the time of connecting the unit 26 and the unit 4 with each other by the unit coupling step, they are connected, while abutting the engaging member 50 of the coupling 39 to the recess 29*a*1 provided in the unit 26. The coupling 39 is swingably mounted to the unit 4.

The cartridge 7 of the embodiment described above is summarized as follows.

The cartridge 7 dismountably mounted to the apparatus main assembly 100*a* of an electrophotographic image forming apparatus 100 includes the photosensitive drum 1 and the unit 26 which supports the photosensitive drum 1. The cartridge 7 includes the developing roller 25 for developing the electrostatic latent image formed on the photosensitive drum 1 in the state of contacting to the photosensitive drum 1, and the developer supplying roller 34 for supplying the developer to the developing roller. The cartridge 7 includes the developer accommodating portion 31*a* for containing the developer used by the developing roller 25 for the development of the electrostatic latent image and which is provided with the developer supply opening 64 for supplying the contained developer to the developing roller 25. The cartridge 7 includes the unit 4 which supports the developing roller 25 and the developer supplying roller 34 and the developer accommodating portion 31*a* and which is swingably connected with the unit 26. In order to maintain the spacing of the developing roller 25 from the photosensitive drum 1, the cartridge 7 includes the first developing device spacing member 40*a* rotatable about the axis of the shaft at the one-end portion of the developing unit 4, so as to prevent the unit 4 from rotating relative to the unit 26. This spacer member 40*a* is detachably engaged to an end side engaging portion 42 provided at the one-end portion of the unit 26. In order to maintain the spacing state of the developing roller 25 from the photosensitive drum 1, it includes the second developing device spacing member 40*b* provided rotatably about the axis of the shaft 27L8 at the other end portion of the unit 26, so that the rotation relative to the unit 26 of the unit 4 is limited. The spacer member 40*b* is detachably engaged with the other end engaging portion 47 provided at the other end portion of the unit 4. With this structure, the process cartridge which can be easily assembled is provided.

As has been described hereinbefore, according to the cartridge 7 of the present embodiment, the spacer member 40*a* is mounted rotatably about the axis of the shaft 40*a*3 at the one-end portion of the unit 4. The spacer member 40*a* is rotated about the axis of the shaft 40*a*3 to make it engage with the opening 42. By this, the developing device spacing can be carried out. Therefore, by rotating the spacer member 40*a* about the axis of the shaft 40*a*3, the developing device spacing can be carried out. In other words, the developing device spacing can be carried out easily.

According to the cartridge 7 of the present embodiment, the spacer member 40*b* is mounted rotatably about the axis of the shaft 27L8 at the other end portion of the unit 26. And, the spacer member 40*b* is rotated about the axis of the shaft 27L8 to engage with the projection 47. By this, the developing device spacing can be carried out. Therefore, by rotating the spacer member 40*b* about the axis of the shaft 27L8, the developing device spacing can be carried out. In other words, the developing device spacing can be carried out easily.

By this, the spacing state of the developing roller 25 from the photosensitive drum 1 can be maintained. Therefore, the production of an impressions on an elastic layer applied on the peripheral surface of the developing roller 25 can be prevented.

In the case where it releases the developing device spacing, the spacer members 40*a*, 40*b* may be rotated in the direction opposite the direction described above. Accordingly, also in this case, the operativity can be improved.

Here, the engaging portion 42 is in the form of an opening, by the contact, with the edge of the opening 42, of the spacer member 40*a*, the rotation of the unit 4 relative to the unit 26 is prevented. In addition, the engaging portion 47 is in the form of a projection, in the state in which the spacer member 40*b* is in engagement with the projection 47, the spacer member contacts with the projection 27L9 provided on the unit 4. By this, the rotation of the unit 4 is regulated relative to the unit 26. With this structure, unintended occurrence of the releasing between the spacer member 40*a* and the spacer member 40*b* can be prevented.

The spacer member 40*a* is provided at the leading end of the unit 4, and the engaging portion 42 is provided at the free end of the unit 26, with respect to the mounting direction in which the cartridge 7 is mounted to the apparatus main assembly 100*a*. The spacer member 40*b* is provided at the trailing end of the unit 26, and the engaging portion 47 downwardly projects in the trailing end side of the unit 4, in the state in which the cartridge 7 is mounted to the apparatus main assembly 100*a*. In this manner, according to this embodiment, since the spacer member 40*a* is provided at the free end of the unit 4, the mounting to the unit 4 is easy.

In addition, since the spacer member 40*b* is provided at the trailing end of the unit 26, it is easy to mount to the unit 26.

In addition, according to this embodiment, in the state of the cartridge 7 having been from the apparatus main assembly 100*a*, the developing device spacing can be made assured.

In the assembling method, the disassembling method and the remanufacturing method for the process cartridge which have been described above, the above described steps may be simultaneously carried out by the different operators. In addition, the orders of the steps of described in the embodiments and the claims may be changed properly.

In addition, the assembly, disassembling, and the remanufacturing of the process cartridge can be carried out manually, automatically using automatic machine or machines, or through a combination of manual and automatic operations. The proper jigs and/or tools may be used.

In the embodiment described above, the used process cartridge is collected and disassembled. Then, the same parts taken out from the process cartridges by disassembling are collected for every part. Thereafter, using such a part or parts and/or partly using a new part or parts (for non-reusable part or parts), the process cartridge may be reproduced by the remanufacturing method described above. Alternative way will be described, after used process cartridges are collected and disassembled. Using the part or parts obtained from the used cartridge, partly using a new part or parts (for non-reusable part or parts), or partly using a part or parts taken out of another used cartridge, the process cartridge is reproduced by the remanufacturing method described above. Therefore, in the claim or claims the parts with "said", "the" or "such" cover the same parts as aforementioned, or the other members having the same functions.

As has been described hereinbefore, according to the embodiment described above, the process cartridge with which the assembling is easy is provided. In addition, the process cartridge with which disassembling is simple is provided. Additionally, the remanufacturing method for the simple process cartridge is provided. Moreover, the remanufacturing method for the process cartridge which can make usable the process cartridge which have become unusable as a result of consumption of the developer is provided. Furthermore, the simple refilling of the developer for the process cartridge from which the developer has been consumed is provided.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 137769/2008 filed May 27, 2008 which is hereby incorporated by reference.

What is claimed is:

1. A remanufacturing method for a process cartridge, wherein the process cartridge includes a drum unit and a developing unit, said drum unit supporting an electrophotographic photosensitive drum, and said developing unit supporting a developing roller for developing an electrostatic latent image formed on said electrophotographic photosensitive drum and a developer accommodating portion having a developer supply opening, said method comprising:

a unit separating step of separating said drum unit and said developing unit from each other;

a developing roller dismounting step of dismounting said developing roller from said developing unit;

a developing refilling step, following said developing roller dismounting step, of refilling a developer into said developer accommodating portion through said developer supply opening that is exposed;

a developing roller mounting step of mounting said developing roller or a fresh developing roller to said developing unit;

a unit coupling process of swingably coupling said drum unit and said developing unit with each other;

a first-end developing-device spacing member mounting step of engaging a first-end developing-device spacing member provided movably at one end portion side of said process cartridge with said drum unit and said developing unit to space said developing roller from said electrophotographic photosensitive drum; and a second-end developing-device spacing member mounting step of engaging a second-end developing-device spacing member provided movably at the other end portion side of said process cartridge with said drum unit and said developing unit to space said developing roller from said electrophotographic photosensitive drum, wherein said first-end developing-device spacing member is provided rotatably at said developing unit and is engaged with an opening provided at said drum unit by said first-end developing-device spacing member mounting step, and wherein said second-end developing-device spacing member is provided rotatably at said drum unit and is engaged with a projection provided at said developing unit by said second-end developing-device spacing member mounting step.

2. A method according to claim 1, further comprising a toner seal mounting step of mounting a toner seal to said developer accommodating portion so as to close the exposed said developer supply opening and mounting a first end of the toner seal to a toner seal winding-up shaft, after a developer is refilled into said developer accommodating portion by said developer refilling step.

3. A method according to claim 1, further comprising:

a developing blade dismounting step of dismounting, from said developing unit, a developing blade for regulating an amount of a developer deposited on a peripheral surface of said developing roller, before said developing roller dismounting step; and a developer supplying roller dismounting step of dismounting a developer supplying roller for supplying the developer to said developing roller from said developing unit, before said developing roller dismounting step;

a developer supplying roller mounting step of mounting said developer supplying roller or a fresh developer supplying roller to said developing unit, after said developer refilling step; and a developing blade mounting step of mounting said developing blade or a fresh developing blade to said developing unit, after said developer refilling step.

4. A method according to claim 1, further comprising, a drum dismounting step of dismounting said electrophotographic photosensitive drum from said drum unit, after said unit separating step and before said unit coupling process; and a drum mounting step of mounting a fresh electrophotographic photosensitive drum in said drum unit, after said unit separating step and before said unit coupling process.

5. A remanufacturing method for a process cartridge, wherein the process cartridge includes a drum unit and a developing unit, said drum unit supporting an electrophotographic photosensitive drum, and said developing unit supporting a developing roller for developing an electrostatic latent image formed on said electrophotographic photosensitive drum and a developer accommodating portion having a developer supply opening, said method comprising:

a unit separating step of separating said drum unit and said developing unit from each other;

a drum dismounting step of dismounting said electrophotographic photosensitive drum from said drum unit;

a drum mounting step of mounting a fresh electrophotographic photosensitive drum in said drum unit;

a unit coupling step of swingably coupling said drum unit and said developing unit with each other;

a first-end developing-device spacing member mounting step of engaging a first-end developing-device spacing member provided movably at one end portion side of said process cartridge with said drum unit and said developing unit to space said developing roller from said electrophotographic photosensitive drum; and a second-end developing-device spacing member mounting step of engaging a second end developing-device spacing member provided movably at the other end portion side of said process cartridge with said drum unit and said developing unit to space said developing roller from said electrophotographic photosensitive drum, wherein said first-end developing-device spacing member is provided rotatably at said developing unit and is engaged with an opening provided at said drum unit by said first-end developing-device spacing member mounting step, and wherein said second-end developing-device spacing member is provided rotatably at said drum unit and is engaged with a projection provided at said developing unit by said second-end developing-device spacing member mounting step.

6. A method according to claim 5, further comprising:

a developer removing step of removing the developer, through an opening of a removed developer accommodating portion, from a removed developer accommodating portion accommodating a developer removed from said electrophotographic photosensitive drum by said cleaning member, after dismounting a cleaning member mounted to said drum unit to remove the developer remaining on said electrophotographic photosensitive drum, after dismounting a charging roller mounted to said drum unit to charge said electrophotographic photosensitive drum, and after taking out said electrophotographic photosensitive drum from said drum unit by said drum dismounting step.

* * * * *